US005153364A

United States Patent [19]

Uchiyama et al.

[11] Patent Number: 5,153,364

[45] Date of Patent: Oct. 6, 1992

[54] OPERATED POSITION DETECTING APPARATUS AND ELECTRONIC MUSICAL INSTRUMENTS PROVIDED THEREWITH

[75] Inventors: Shigeru Uchiyama, Sayama; Yoshiyuki Murata, Tachikawa, both of Japan

[73] Assignee: Casio Computer Co., Ltd., Tokyo, Japan

[21] Appl. No.: 749,538

[22] Filed: Aug. 23, 1991

Related U.S. Application Data

[62] Division of Ser. No. 354,131, May 19, 1989, Pat. No. 5,065,659.

[30] Foreign Application Priority Data

May 23, 1988 [JP] Japan ..... 63-125592
Jun. 17, 1988 [JP] Japan ..... 63-149534

[51] Int. Cl.[5] ..... G10H 1/18

[52] U.S. Cl. ..... 84/742; 84/DIG. 30; 341/20; 340/825.79; 200/5 A; 200/52 R

[58] Field of Search ..... 84/616, 646, 654, 681, 84/722-728, 730, 731, 733, 734, 742, DIG. 12, DIG. 30; 341/20-35; 340/825.79; 200/5 R, 5 A, 52 R

[56] References Cited

U.S. PATENT DOCUMENTS 3,629,480 12/1971 Harris ..... 84/DIG. 12
3,637,914 1/1972 Hiyama ..... 84/DIG. 12
3,786,167 1/1974 Borell et al. .
3,787,601 1/1974 Campbell ..... 84/DIG. 12
3,871,247 3/1975 Bonham .
3,902,395 9/1975 Avant .
4,038,897 8/1977 Murray et al. .
4,137,811 2/1979 Kakehashi .
4,306,480 12/1981 Eventoff .
4,321,852 3/1982 Young, Jr. .
4,372,187 2/1983 Berg .
4,430,918 2/1984 Meno ..... 84/722
4,468,997 9/1984 Young, Jr. .
4,570,521 2/1986 Fox .
4,630,520 12/1986 Bonanno .
4,653,376 3/1987 Allured .
4,658,690 4/1987 Aitken .
4,677,419 6/1987 Meno .
4,702,141 10/1987 Bonanno .
4,760,767 8/1988 Tsurubuchi .
4,817,484 4/1989 Iba .
4,841,827 6/1989 Uchiyama .
4,911,053 3/1990 Kashio et al. .
4,919,031 4/1990 Matsumoto .
5,025,703 6/1991 Iba et al. .
5,040,447 8/1991 Murata et al. .

FOREIGN PATENT DOCUMENTS 0142390 5/1985 European Pat. Off. .
59-176783 10/1984 Japan .
60-166992 8/1985 Japan .
62-159183 7/1987 Japan .
62-174795 7/1987 Japan .
63-29193 2/1988 Japan .
WO87/00330 1/1987 World Int. Prop. O. .

*Primary Examiner*—Stanley J. Witkowski
*Attorney, Agent, or Firm*—Frishauf, Holtz, Goodman & Woodward

[57] ABSTRACT

A detecting device for detecting the positions where strings are operated, and an electronic musical instrument using the detecting device, such as an electronic stringed instrument or an electronic keyboard instrument, wherein each of frets, with which conductive strings are brought into contact, is formed of a two-layer structure of a conductive member and a resistance member provided on the conductive member. Voltage pulses are sequentially applied to either the conductive strings or the conductive members of the frets and a voltage pulse is detected from a conductive member or a string, thus detecting a position in which a string is stopped against the fret.

14 Claims, 32 Drawing Sheets

OPERATED POSITION DETECTING APPARATUS AND ELECTRONIC MUSICAL INSTRUMENTS PROVIDED THEREWITH

This is a division of application Ser. No. 07/354,131 filed May 19, 1989, now U.S. Pat. No. 5,065,659 issued Nov. 19, 1991.

BACKGROUND OF THE INVENTION

1. Field of the Invention

The present invention relates to an operated position detecting apparatus for detecting a plurality of operated positions, and electronic musical instruments using the same, such as electronic stringed instruments including an electronic guitar, guitar synthesizer and electronic violin, and electronic keyboard instruments including an electronic organ and an electronic piano.

2. Description of the Related Art

With recent, rapid developments of electronic technology and digital technology, multifarious electronic stringed instruments have been developed. The electronic stringed instruments can be classified into an electronic string rubbing instrument represented by an electronic violin and an electronic string plucking instrument represented by an electronic guitar or guitar synthesizer. The feature of such types of electronic stringed instruments or the present invention lies in that musical sounds having pitches specified by a fingering operation done to a fingerboard or a plurality of strings stretched over the fingerboard and a music is played while generating musical sounds from a musical tone generator constituted by an analog circuit, a digital circuit or the like, based on a string rubbing operation or a string plucking operation.

There are two important points in developing an electronic stringed instrument having the above arrangement. The first one is how to detect with high accuracy the status of the string rubbing or string plucking operation conducted by a player. The second one is to how to surely and quickly detect the positions on the fingerboard where the fingering operation has been executed by the player. Particularly, great efforts have been devoted to developing the latter technique of detecting the fingering initiated positions.

There are several techniques known or proposed to detect the fingering initiated positions.

The first conventional example is a fret switch system.

According to this system, ON/OFF type fret switches are embedded in a fingerboard at those positions which correspond to a number of fret positions and fingering initiated positions are detected based on the presence or absence of an ON/OFF signal output from those fret switches activated by the finger operation.

The use of this system is disclosed in, for example, U.S. Pat. No. 4,570,521 (Jeffrey Fox) issued Feb. 18, 1986.

The use of this system is also proposed in the following pending U.S. patent applications filed by the same assignee as that of the present application:

1) Ser. No. 069,612 (Yukio Kashio et al.) filed Jul. 1, 1987 and corresponding Japanese Utility Model Disclosure No. 63-29193.

2) Ser. No. 094,402 (Yoshiyuki Murata et al.) filed Sep. 8, 1987.

3) Ser. No. 171,883 (Naoaki Matumoto) filed Mar. 21, 1988.

4) Ser. No. 184,099 (Akio Iba et al.) filed Apr. 20, 1988.

5) Ser, No. 256,398 (Akio Iba et al.) filed Oct. 7, 1988.

The second conventional example is a system of detecting the resistance of a string.

According to this system, a current is supplied to a string having an electric resistance and the effective length of that string to a conductive fret in contact with the string is detected as a voltage corresponding to the resistance of this string, thereby detecting where the string is pressed.

This system is disclosed in the following patent publications:

1) U.S. Pat. No. 4,306,480 (Frank Eventoff) issued Dec. 22, 1981.

2) U.S. Pat. No. 4,468,997 (Leroy D. Young, Jr.) issued Sep. 4, 1984 and corresponding Japanese Patent disclosure No. 59-176783.

3) U.S. Pat. No. 4,653,376 (David Allured) issued Mar. 31, 1987.

4) U.S. Pat. No. 4,677,419 (Frank Meno, Assignee: University of Pittsburgh) issued Jun. 30, 1987.

5) U.S. Pat. No. 4,630,520 (Carmine Bonanno) issued Dec. 23, 1986.

6) U.S. Pat. No. 4,702,141 (Carmine Bonanno) issued Oct. 27, 1987.

7) Japanese Patent Disclosure No. 62-174795 (M. Kondo, Assignee: Yamaha Corp.) laid open on Jul. 31, 1987.

The third conventional example includes an electric pulse application system and a current supply system.

According to these systems, an electric pulse signal or string current is sequentially supplied to a plurality of conductive strings and this pulse signal is detected through elongated conductive frets which are in contact with the strings, thereby detecting the positions of the strings pressed.

The systems are disclosed in the following gazettes:

1) U.S. Pat. No. 3,786,167 (James J. Borell et al.) issued Jan. 15, 1974.

2) U.S. Pat. No. 3,871,247 (Arthur R. Bonham) issued Mar. 22, 1981.

3) U.S. Pat. No. 3,902,395 (William L. Avant) issued Sep. 2, 1975.

4) U.S. Pat. No. 4,038,897 (Jeffrey J. Murray et al., Assignee: Electronic Music Laboratories, Inc.) issued Aug. 2, 1977.

5) U.S. Pat. No. 4,137,811 (Ikutaro Kakehashi, Assignee: Roland Corp.) issued Feb. 6, 1979.

6) U.S. Pat. No. 4,321,852 (Leroy D. Young, Jr.) issued Mar. 30, 1982.

7) U.S. Pat. No. 4,372,187 (Arne L. Berg, Assignee: AB Laboratories) issued Feb. 8, 1983.

8) EP Disclosure No. 142,390 Al (Cintra, Daniel, et al.) published May 22, 1985 and corresponding Japanese Patent Disclosure No. 60-166992.

The fourth conventional example is an induced voltage detecting system. According to this system, a current is supplied to a plurality of conductive strings and it is discriminated from which one of coils provided in association with a plurality of conductive frets, the current is detected as an induced voltage, thereby detecting the pressed positions of strings.

Such a system is disclosed in, for example, U.S. Pat. No. 4,760,767 (Tooru Tsurubuchi, Assignee: Roland Corp.) issued Aug. 2, 1988.

The fifth conventional example is a fret detecting system with a two-layered resistive layer structure.

According to this system, a voltage pulse is sequentially applied to the individual frets of a resistive layer structure consisting of two layers having different resistances and a string current flowing through conductive strings which are in contact with the frets is detected, thereby detecting the pressed positions of the strings.

Such a system is disclosed in, for example, PCT, WO No. 87/00330 (Pyan, Paul et al., Applicant: STEPP ELECTRONICS LIMITED) laid open Jan. 15, 1987.

According to this example, each fret to be in contact with strings comprises an upper resistive layer of a high contact resistance and a lower resistive layer of a low contact resistance. The reason for employing such a structure is described as follows in WO-87/00330. With stings pressed as indicated by p and q in FIG. 31, for example, if a voltage is applied to the first fret to detect whether or not this fret is in contact with any string, a current flows across the first string through the contact resistance of the first fret and the contact of the first string with the first fret is detected by string current detecting means coupled to the first string. If the contact resistance of the fret is small, however, the current flowing across the first string also flows through the second string via the contact resistance of the second fret due to the internal resistance or the like of the string current detecting means coupled to the first string. Therefore, the string current detecting means coupled to the second string may detect the contact of the first fret with the first string. This would result in an erroneous detection of the pressed positions of strings, leading to erroneous pitch detection. It is therefore necessary to surely prevent the undesirable current flow to the wrong string.

When a pitch bend operation is performed after a string is pressed against a fret, it is necessary to detect somehow the position of the string in contact with the fret along the length thereof in order to detect the status of the pitch bend operation. In order to satisfy the above two requirements, therefore, the fifth conventional example appears to have employed the aforementioned fret structure in which each fret is constituted by the upper resistive layer of a high contact resistance and the lower resistive layer of a low contact resistance.

According to the fifth conventional example, it is suggested that circuit means for detecting the contact of frets connected to the individual strings with any string should be designed to detect a current flowing across each string. More specifically, as it is discussed that the frets should have a high contact resistance in view of a current which may flow across other strings, it is understood that the circuit means coupled to each string to detect the contact between a fret and a string, which is described in the preamble of claim 1 in WO-87/00330 relating to the fifth conventional example, should be designed to detect a current flowing across each string.

Further, it is indicated that, according to the fifth conventional example, the fret structure is provided in such a way that the first conductive layer (lower resistive layer) having the first specific resistance is deposited at the lower part of the second conductive layer (upper resistive layer) constituting a contact resistance and the first specific resistance of the first conductive layer should be large enough not to be neglected. This is said to be the essential factor in the fifth conventional example to detect not only the contact with a fret but also a pitch bend operation after the contact is made.

The sixth conventional example is a system which uses a conductive fret consisting of a plurality of conductive pieces and a plurality of strings in combination with an electronic circuit in order to detect the pressed positions of strings. This system is disclosed in, for example, U.S. Pat. No. 4,658,690 (William A. Aitken, Assignee: Synthaxe Limited) issued Apr. 21, 1987.

This electronic stringed instrument detects which sting is pressed at what fret position by a player to thereby control the pitch of a musical sound, etc. In this respect, it is considered that a player of an electronic stringed instrument plays a music by performing the ON/OFF operation of the desired switch included in a sort of a switch matrix constituted by a combination of a plurality of frets and a plurality of strings.

Accordingly, it is necessary to employ a technique of accurately detect the aforementioned string pressing operation. More specifically, it is necessary to use a technique of effectively and accurately detect the operation of an arbitrary switch in the switch matrix.

The seventh conventional example relates to such a technique but is not restricted to an electronic stringed instrument and is disclosed as a switch matrix circuit. This example is designed in such a way that a diode for preventing a signal from traveling to undesirable components is coupled to each switch located at the cross point between each row and column of a switch matrix.

The eighth conventional example relating to a similar technique is designed in such a way that a switch matrix is constituted by simple switches, the number of simultaneously operable switches is limited to one or two, and a circuit for detecting whether or not three or more switches are operated in order to prevent a malfunction. This system is disclosed in, for example, Japanese Patent Disclosure No. 62-159183 (Assignee: Yamaha Corp.).

According to the first conventional example, however, fret switches should be embedded one by one inside the neck at those positions corresponding to the individual strings between a plurality of frets, thus increasing the manufacturing cost of the neck portion. In addition, when this system is combined with a system for detecting string vibration by means of a pickup and amplifying the detected output before generating a musical sound, it is inevitable to degrade the quality of a musical sound due to the required processing of the neck portion.

According to the second conventional example, generally speaking, there is no material for the strings which have the same function as those of an ordinary guitar and have a resistance large enough to clearly show the potential difference caused by the difference between the positions of pressed frets. Further, it is difficult to design a compact circuit which permits the flow of a large current across a string having a low resistance in order to get a large potential difference from that string.

The third conventional example has the following shortcomings. If the first string 1 (#1) and second string 1 (#2) in FIG. 31 are pressed as indicated by "p" and "q" in the diagram, for example, the first string 1 (#1) contacts the (n+1)-th fret 2 (#n+1) and the (n+2)-th fret 2 (#n+2), and the second string 1 (#2) contacts the n-th fret 2 (#n) and the (n+1)-th fret 2 (#n+1). When, under this circumstance, an electric pulse signal is supplied to the second string 1 (#2) from the direction of A in the diagram, however, this signal travels through the (n+1)-th fret 2 (#n+1) to the first string 1 (#1) from the second string 1 (#2) and will be detected from the (n+2)-th fret 2 (#n+2) which is not in contact with the second string 1 (#2).

According to the fourth conventional example, since a coil should be embedded in the neck for each fret, the manufacturing cost of the neck portion increases and the quality of a musical sound is deteriorated as per the first conventional example.

According to the fifth conventional example, since the upper resistive layer that will contact strings should have a high contact resistance and be made of a material having a wear-resistance high enough to resist the contact with the strings, the type of the material for this layer is restricted, thus narrowing the freedom of selecting the material for frets. Further, the circuit for detecting a large current flowing through strings from the frets comprising the upper resistive layer with a high contact resistance and the lower resistive layer with a low contact resistance should have a very complex circuit structure like a transformer, for instance. This raises the general cost of electronic musical instruments. Furthermore, to detect a pitch bend operation, it is necessary to provide, for each fret, a transformer which supplies a difference voltage for detection of the pitch bend operation to the lower resistive layer of each two-layered fret. A complicated control circuit including a feedback loop should also be provided to set a detected voltage value corresponding to the reference position of each string to 0. This feedback control requires a considerably fine initial setting and thus increases hardware components of the control circuit for detecting a pitch bend, resulting in an increase in cost.

In addition, a transformer for detecting a pitch bend needs to be embedded in the neck portion as per the first and fourth conventional examples. Accordingly, the manufacturing cost of the neck portion increases and the neck needs processed considerably, which is likely to degrade the sound quality.

According to the sixth conventional example, the flow of a current to undesirable components is prevented by causing a plurality of conductive strings supplied with a current to contact a plurality of electronically independent conductive pieces. This precaution, however, requires wiring for the number of the strings for each fret, thus increasing an electric complexity of the system for detecting a contact between frets and strings and increasing the mechanical complexity of the fingerboard as well.

According to the seventh conventional example, a diode is necessary for each switch of the switch matrix, thus inevitably increasing the switch matrix part.

According to the eighth conventional example, the number of simultaneously operable switches is restricted to 2, thus narrowing the range of electronic devices to which the switch matrix is applicable.

SUMMARY OF THE INVENTION

Accordingly, it is an object of this invention to provide an operated position detecting apparatus which can be produced at a low cost without requiring that a diode for preventing a current from flowing to undesirable components be provided for each switch element.

It is another object of this invention to provide an electronic musical instrument which can be produced at a low cost without requiring a number of pitch-setting switches in a fingerboard.

It is a further object of this invention to provide an electronic musical instrument which can accurately detect the point of contact between each string and each fret with a simple arrangement.

It is a still further object of this invention to provide an electronic musical instrument which can accurately detect the pressed positions of strings using ordinary steel strings that are used in traditional electronic guitars, guitar synthesizers, etc.

It is a still another object of this invention to provide an electronic musical instrument which has a simple circuit structure for those portions around the individual frets to thereby reducing its general cost.

To begin with, the first mode of this invention will be described below. This mode is premised on an electronic musical instrument which comprises a plurality of frets disposed at predetermined internals therebetween, a plurality of conductive strings stretched over and across the individual frets at predetermined intervals, string pressed position detecting means for responding to an event of any of the strings being pressed and detecting the pressed position of the pressed string, and pitch designating means for designating a pitch of a musical sound to be generated in accordance with the detected position of the pressed string.

According to this mode, each fret has a two-layered structure comprising a conductive member made of a conductive material whose electric resistance is negligible and a resistive member formed at that portion of the conductive member with which each string can come in contact. The resistive member has such a thickness that its resistance along the film thickness is sufficiently larger than the resistance along the length which appears between strings when two adjoining strings simultaneously contact this resistive member.

The string pressed position detecting means comprises the following voltage applying means, voltage detecting means and detecting means. The voltage applying means sequentially applies a voltage pulse to a plurality of strings, and when applying no voltage pulse to these strings, it keeps those strings which are not applied with the voltage pulse at the ground potential. This voltage applying means may be a buffer circuit with a sufficiently small output impedance. The voltage detecting means sequentially detects a voltage applied by the voltage applying means from the conductive member of each fret through the resistive member. The last-mentioned detecting means detects the pressed position of each string by a combination of the string applied with a voltage pulse by the voltage applying means and that fret from which the voltage is detected by the voltage detecting means As an alternative, the string pressed position detecting means may comprise voltage applying means, which sequentially applies a voltage pulse to the conductive members of a plurality of frets and which, when applying no voltage pulse to the conductive members of the frets, keeps the conductive members of those frets which are not applied with the voltage pulse at the ground potential; voltage detecting means which sequentially detects a voltage applied by the voltage applying means from the conductive member of each string through the resistive member; and detecting means which detects the pressed position of each string by a combination of the fret applied with a voltage pulse by the voltage applying means and that string from which the voltage is detected by the voltage detecting means.

The second mode of this invention will be described below. This mode is also premised on an electronic stringed instrument similar to that of the first mode.

Each string has a three-layered structure which comprises a conductive string member formed at the center portion and having a negligible electric resistance, a resistive member formed integrally with the peripheral portion of this conductive string member and conductive member formed integrally with the peripheral portion of the resistive member, contactable with each fret and having a negligible electric resistance.

As an alternative, each string has a two-layered structure which comprises a conductive string member formed at the center portion and having a negligible electric resistance, and a resistive member formed integrally with the peripheral portion of this conductive string member and contactable with each fret.

The string pressed position detecting means comprises the following voltage applying means, voltage detecting means and detecting means. The voltage applying means sequentially applies a voltage pulse to the conductive string members of a plurality of strings, and when applying no voltage pulse to these conductive string members, it keeps the conductive string members of those strings which are not applied with the voltage pulse at the ground potential. The voltage detecting means sequentially detects a voltage applied by the voltage applying means from each fret through the resistive member and conductive member. The last-mentioned detecting means detects the pressed position of each string by a combination of the string applied with a voltage pulse by the voltage applying means and that fret from which the voltage is detected by the voltage detecting means.

As an alternative, the string pressed position detecting means may comprise voltage applying means, which sequentially applies a voltage pulse to a plurality of frets and which, when applying no voltage pulse to the frets, keeps those frets which are not applied with the voltage pulse at the ground potential; voltage detecting means which sequentially detects a voltage applied by the voltage applying means from the conductive string member of each string through the conductive member and resistive member; and detecting means which detects the pressed position of each string by a combination of the fret applied with a voltage pulse by the voltage applying means and that string from which the voltage is detected by the voltage detecting means.

The third mode of this invention will be described below. This mode is premised on a switch matrix having a plurality of switch elements provided at the individual cross points between a plurality of row connecting lines and a plurality of column connecting lines to connect the row and column connecting lines, and on string pressed position detecting device that detects which switch element is activated from the statuses of the individual signals from the individual row and column connecting lines.

At each cross point, a resistive member having a predetermined resistance is provided.

Voltage applying means is provided which applies a voltage pulse to each row connecting line and keeps other row connecting lines which are not applied with the voltage pulse at the ground potential.

Voltage detecting means is provided which sequentially detects the voltage applied by the voltage applying means from the individual column connecting lines through the resistive members.

Operated position detecting means is provided which detects which switch element is activated by a combination of the row connecting line applied with the voltage pulse by the voltage applying means and the column connecting line from which the voltage is detected by the voltage detecting means.

As an alternative, the circuit relation between the row connecting lines and the column connecting lines may be reversed.

According to the above mode, the resistive member is formed integrally at each cross point on the side of at least one of the row and column connecting lines of the cross point. The resistive member may alternatively be integrally formed with that connecting line. The row connecting lines and column connecting lines are formed on, for example, a printed-wiring board and each switch element is provided at its associated cross point on this board. Further, each switch element has a resilient member that is flexible in response to a pressing operation, and part of one of the row and column connecting lines is integrally formed with the lower portion of the resilient member.

The fourth mode of this invention will be described below. This mode is premised on an electronic stringed instrument similar to that of the first or second mode.

According to this mode, each fret has a structure comprising a plurality of conductive members contactable and electrically independent for each string, a resistive member provided at the lower portion of each conductive member and a wiring member provided at the lower portion of the resistive member.

The string pressed position detecting means comprises the following voltage applying means, voltage detecting means and detecting means. The voltage applying means sequentially applies a voltage pulse to a plurality of strings, and keeps other strings which are not applied with the voltage pulse at the ground potential. The voltage detecting means sequentially detects a voltage applied by the voltage applying means from any of the conductive members through the resistive members and wiring members. The last-mentioned detecting means detects the pressed position of each string by a combination of the string applied with a voltage pulse by the voltage applying means and that fret from which the voltage is detected by the voltage detecting means.

As an alternative, the string pressed position detecting means may comprise voltage applying means, which sequentially applies a voltage pulse to the wiring members and keeps the conductive members of those wiring members which are not applied with the voltage pulse at the ground potential; voltage detecting means which sequentially detects a voltage applied by the voltage applying means from each string through the wiring member and resistive member; and detecting means which detects the pressed position of each string by a combination of the fret applied with a voltage pulse by the voltage applying means and that string from which the voltage is detected by the voltage detecting means.

Of the above-described modes, the first, second or fourth mode may be modified to comprise pitch bend adding means for adding a pitch bend effect to the pitch designated by the pitch designating means based on the amount of a pitch bend operation executed with respect to any string. Specifically, the modification comprises slide type variable resistor means which engages with each string and can change its resistance in accordance with a pitch bend operation executed with respect to that string, and pitch bend adding means which controls the pitch designated on the basis of the pressed position of each string detected by the string pressed position detecting means in accordance with each resistance of the variable resistor means and adds a pitch bend effect to this pitch. As an alternative, the modification may comprise string vibration waveform detecting means provided for each string to detect a string vibration waveform of that string, pitch extracting means for extracting each pitch period of the string vibration waveform detected by the string vibration waveform detecting means, and pitch bend adding means which controls the pitch designated on the basis of the pressed position of each string detected by the string pressed position detecting means in accordance with the pitch period extracted by the pitch extracting means and adds a pitch bend effect to this pitch.

Furthermore, according to the first, second or fourth mode, the voltage detecting means comprises a select switch for selecting any of the frets and a comparator for comparing the output voltage value of the switch with a predetermined threshold voltage. Alternatively, the comparator may be provided for each string, each row connecting line or each column connecting line in order to eliminate the need for the select switch. The comparator may be replaced by a transistor circuit which performs the switching operation in accordance with the value of a voltage applied on the input side. In addition, A/D converter means for converting an output voltage value into a digital value may be provided on the output side of the select switch and discriminating means for discriminating the digital value may be provided for voltage detection.

According to the first or fourth mode, instead of the relation of the strings and frets, a more general cross type contact structure may be employed, which permits the application of this invention to various devices. In view of each cross section being detected by such an operated position detecting device, the electronic musical instrument may be designed in such a way that the pitch of a musical sound to be generated is designated by pitch designating means and the musical sound having this designated pitch is generated from tone generating means.

The fifth mode of this invention will now be described. This mode is premised on an electronic musical instrument which comprises a plurality of frets disposed at predetermined intervals therebetween in a direction normal to the lengthwise direction of a fingerboard; a plurality of conductive strings stretched over the frets along the length of the fingerboard; string vibration detecting means for detecting vibration of each of the strings; pitch bend detecting means for detecting a pitch bend operation done with respect to the strings; string pressed position detecting means for, when a specific one of the frets comes in contact with that of the strings which is pressed, detecting a pressed position of that string which is associated with the specific fret; instructing means for, upon detection of start of vibration of a string by the string vibration detecting means, instructing start of generation of a musical sound associated with that string; and pitch control means for controlling a pitch of a musical sound to be generated when the start of musical sound generation is instructed by the instructing means in accordance with pitch data corresponding to the pressed position of the string detected by the string pressed position detecting means and controlling a pitch of a musical sound to be generated when a pitch bend operation is detected by the pitch bend detecting means after the start of musical sound generation is instructed by the instructing means, in accordance with pitch bend data corresponding to the pitch bend operation.

As an alternative, the string pressed position detecting means may comprise voltage applying means, which sequentially applies a voltage pulse to either the individual strings or the conductive members of the individual frets and which, when applying no voltage pulse to either the individual strings or the conductive members of the individual frets, keeps the conductive members of those strings or those conductive members which are not applied with the voltage pulse at the ground potential; voltage detecting means which sequentially detects a voltage applied by the voltage applying means from the other of the conductive members of the frets and the strings through a resistive member; and detecting means which detects the pressed position of each string by a combination of that string or fret which is applied with a voltage pulse by the voltage applying means and that fret or string from which the voltage is detected by the voltage detecting means.

Finally, the sixth mode of this invention will be described below. This mode is premised on an electronic musical instrument which comprises a plurality of frets disposed at predetermined intervals therebetween in a direction normal to the lengthwise direction of a fingerboard; a plurality of conductive strings stretched over the frets along the length of the fingerboard; string vibration detecting means for detecting vibration of each of the strings; period measuring means for measuring a reference period of vibration from the string vibration detected by the string vibration detecting means; string pressed position detecting means for, when a specific one of the frets comes in contact with that of the strings which is pressed, detecting a pressed position of that string which is associated with the specific fret; instructing means for, upon detection of start of vibration of a string by the string vibration detecting means, instructing start of generation of a musical sound associated with that string; and pitch control means for controlling a pitch of a musical sound to be generated when the start of musical sound generation is instructed by the instructing means in accordance with pitch data corresponding to the pressed position of the string detected by the string pressed position detecting means and controlling a pitch of a musical sound to be generated after the start of musical sound generation is instructed by the instructing means, in accordance with reference period data measured by the period measuring means.

According to this mode, each fret has a two-layered structure comprising a conductive member and a resistive member as is the case with the above-described modes. The string pressed position detecting means comprises voltage applying means, voltage detecting means and detecting means as per the fifth mode.

The following explains each term used in the descriptions of the individual modes and claims.

The term "predetermined intervals" typically mean unequal intervals corresponding to scale notes of a 12 temperament, but are not restricted to this particular case; for example, they may be equal intervals. Although "predetermined intervals" are set in the units of semitones in view of guitar-like instruments, they are not restricted to this particular case. For instance, the intervals may be set in the units of cents in view of violin-like instruments or may be set in the units of full tones. In the case of an electronic musical instrument using pitch extracting means or period measuring means, however, the intervals should be unequal intervals corresponding to the scale notes of the 12 temperament.

The term "electrically conductive string" does not mean that the entire string should be made of a conductive material. For instance, the string may have only the outer portion made of a conductive material and have the center portion made of an insulative material.

With regard to the term "stretched," a string is typically stretched over a plurality of frets as well as over string vibration detecting means such as a pickup, but is in no way restricted to this case. For instance, each string may be stretched only over the individual frets.

The expression "resistance member formed at in a portion of the conductive member with which each string is contactable" indicates the resistive member formed only the upper portion of the conductive member as shown in FIG. 2, but the provision of the resistive member is not restricted to this particular case. For instance, a film of a cylindrical resistive member with a predetermined with may be formed at the outer portion of the conductive member. Although "formed at that portion of the conductive member with which each string is contactable" means that the resistive member is integrally formed on the conductive member as shown in FIG. 2, the structure is not restricted to this particular case. For instance, a different resistive member may be disposed on the conductive member.

According to the first mode, when a plurality of strings are in contact with one fret, for example, the distance between the strings over the resistive member constituting the fret can be set sufficiently large as compared with the distance between each contacted positions and the conductive member of that fret located under the contacted portions, i.e., the film thickness of the resistive member. Therefore, the strings in contact with the fret are approximately electrically isolated by the resistive member and a voltage pulse travels through the path of string→resistive member→conductive member and conductive member→resistive member→string.

According to a system which employs thus constituted frets and applies a voltage to the frets from strings, an equivalent circuit for detecting, by the voltage detecting means, a voltage pulse only from that fret which is in contact with that string to which the voltage pulse is presently applied can be constituted by causing the voltage applying means to sequentially apply the voltage pulse to the individual strings and keeping those strings to which the voltage pulse is not applied at the ground potential. The pressed position of each string can be detected by causing the detecting means to discriminate the combination of the strings and frets in the above case.

According to a system which applies a voltage to the strings from the frets, however, an equivalent circuit for detecting, by the voltage detecting means, a voltage pulse only from that string which is in contact with that fret to which the voltage pulse is presently applied can be constituted by causing the voltage applying means to sequentially apply the voltage pulse to the individual frets and keeping those frets to which the voltage pulse is not applied at the ground potential. The pressed position of each string can be detected by causing the detecting means similar to the one used in the previous system to discriminate the combination of the frets and strings.

The frets having a two-layered structure comprising the conductive member and resistive member can be easily produced by coating the resistive member on the conductive member. Such frets can be mounted to the neck of the musical instrument by the same processing technique as employed to mount ordinary frets to the neck. In addition, a cord that is to be connected to the conductive member of each fret may be wired using a groove or the like which is normally formed in the center portion of the neck, and the structure of the neck itself may be the same as that of an ordinary guitar This can therefore contribute to reducing the manufacturing cost of the neck and can mostly eliminate the degradation of the quality of a musical sound which is otherwise caused by the processing of the neck portion.

With the use of the voltage drive type system, the resistance of the resistive member constituting a fret, in the direction of the thickness need not be high unlike in the case of the aforementioned fifth conventional example, as long as the relation between the lengthwise resistance and the resistance in the thickness direction can be maintained. This permits selection of a material for the resistive member which can resist the contact with strings from a wide range of materials.

Further, this voltage drive type system can be constituted by an operational amplifier and a microprocessor and does not require a transformer unlike in the case of the fifth conventional example, thus contributing reduction of the cost of electronic musical instruments.

The present system may be designed in such a way that the input side of the string pressed position detecting means or fret voltage detecting means is pulled down to the ground potential by a proper resistance. This can prevent the value at the input side from being variable, resulting in malfunction, when the frets or strings are not in contact with any string or any fret.

Further, in adding a pitch bend function to an electronic musical instrument, particularly, an electronic stringed instrument, since the pitch bend operation is detected by an exclusive device, such as slide type variable resistor means or pitch extracting means for extracting a pitch from a string vibration waveform, this circuit arrangement may be provided separately from the circuit for detecting the positions of pressed strings. As compared with the fifth conventional example, therefore, the circuit arrangement around the fret can be simplified and the circuit adjustment becomes very simple, thus reducing the general cost of electronic musical instruments and improving the reliability thereof.

According to the second mode, in the case where a plurality of strings are in contact with one fret, the conductive string member of each string and the fret are electrically connected together by the resistive member formed at the periphery of the conductive member. With the use of strings having a three-layered structure, a voltage pulse travels through a path of the conductive string member→resistive member at the periphery thereof→conductive member located at the periphery thereof→fret or in the reverse direction. In addition, if the system is constituted with the string pressed position detecting circuit of the first mode, the same effect as that of the first mod can be produced.

The strings with a two-layered structure comprising the conductive string member and resistive member can be easily produced by coating the resistive member on the conductive string member, and the strings with a three-layered structure can be produced by coating the conductive member on the above two-layered structure. In addition, frets can be mounted to the neck of the musical instrument by the same processing technique as employed to mount ordinary frets to the neck. Further, wiring to each fret may easily be made by forming an elongated printed-wiring board along the neck at a groove which is normally formed in the center portion of the neck, so that the structure of the neck itself may be the same as that of an ordinary guitar. This can therefore contribute to reducing the manufacturing cost of the neck and can mostly eliminate the degradation of the quality of a musical sound which is otherwise caused by the processing of the neck portion.

The third mode is not restricted to electronic musical instruments such as electronic stringed instruments but may be applied to a switch matrix of ordinary electronic devices. When a plurality of switch elements on a single row connecting line (or column connecting line) are simultaneously operated, for example, the individual connecting lines and the individual connecting lines are electrically connected via a resistor coupled in series to each switch element, and a voltage pulse travels through a path of row connecting line→switch element→resistor (or resistor→switch element)→column connecting line or in the reverse direction. In addition, with the use of the switch operation detecting circuit as employed in the first mode, a plurality of switching operations simultaneously made can be accurately detected.

Each resistor connected to the switch element can be easily realized at a low cost by forcing a resistive thin film on a printed-wiring board by a carbon printing technique. Particularly, if each switch element is made of a resilient member such as a rubber contact using the carbon printing technique, the resistive thin film can be printed at the same time, hardly requiring cost for forming the resistive thin film. With the use of rubber contact switches, since the contacts themselves have a resistance, an additional resistor is not particularly required and the switches arranged in matrix are sufficient.

As compared with the sixth conventional example, therefore, a switch matrix can be provided at a significantly low cost. As compared with the seventh conventional example, it is possible to provide a switch matrix which ensures selection of applicable electronic devices from a wide range.

The fourth mode is the principle of the third mode applied to a string pressed position detecting system for use in an electronic musical instrument. In other words, the fret comprises a conductive member contactable for each of a plurality of strings and separated for each string by, an insulative member so that the segments are electrically independent from one another, a resistive member connected at the lower portion of the conductive member and a wiring member connected at the lower portion of the resistive member. Accordingly, a voltage pulse travels through a path of string→conductive member→resistive member→wiring member or in the reverse direction. In addition, if the system is constituted with the string pressed position detecting circuit of the first mode, the same effect as that of the first mode can be produced.

The fret with the above-described structure can be easily realized by providing a printed-wiring board at the lower portion of the fret to thereby constitute a wiring member (pattern), coating the resistive member on the wiring member and sandwiching this structure between the insulative member and conductive member. In addition, frets can be mounted to the neck of the musical instrument by the same processing technique as employed to mount ordinary frets to the neck, as per the first or second mode.

Further, instead of the string/fret relation described above, a more general cross type contact structure may be employed, so that an operated position detecting device applicable in a wide range or an electronic musical instrument using such a device can be realized.

According to the fifth mode, pitch bend detecting means for detecting a pitch bend operation with respect to a plurality of strings is provided in addition to the string pressed position detecting means. As compared with the fifth conventional example, therefore, the circuit arrangement around the fret can be simplified and the general cost of an electronic musical instrument can be reduced.

Finally, according to the sixth mode, like the fifth mode, in addition to the string pressed position detecting means, there is provided means for measuring a string vibration period in response to a pitch bend operation with respect to strings or an arming operation by a tremolo arm after generation of a musical sound. Accordingly, the same effect as is produced by the fifth mode can also be attained.

BRIEF DESCRIPTION OF THE DRAWINGS

FIG. 22D shows an enlarged fragment of FIG. 22A;

FIGS. 25A to 25C are diagrams illustrating an equivalent circuit of the ninth embodiment in the case where #2 to #5 of the switch section 45 are simultaneously turned on;

DETAILED DESCRIPTION OF THE PREFERRED EMBODIMENTS

Arrangement of First Embodiment

Figure 1A:
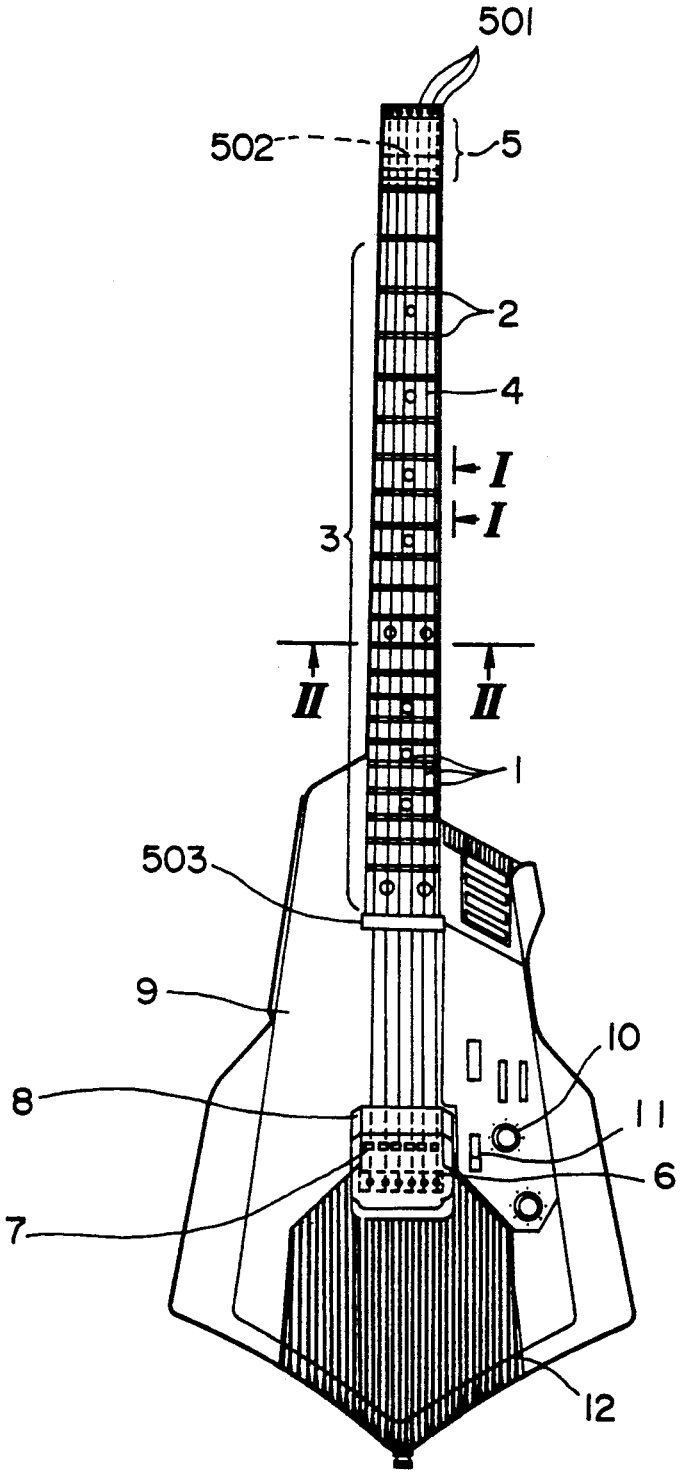
FIG. 1A is an external plan view of an electronic stringed instrument.
Figures 1B, 1C:
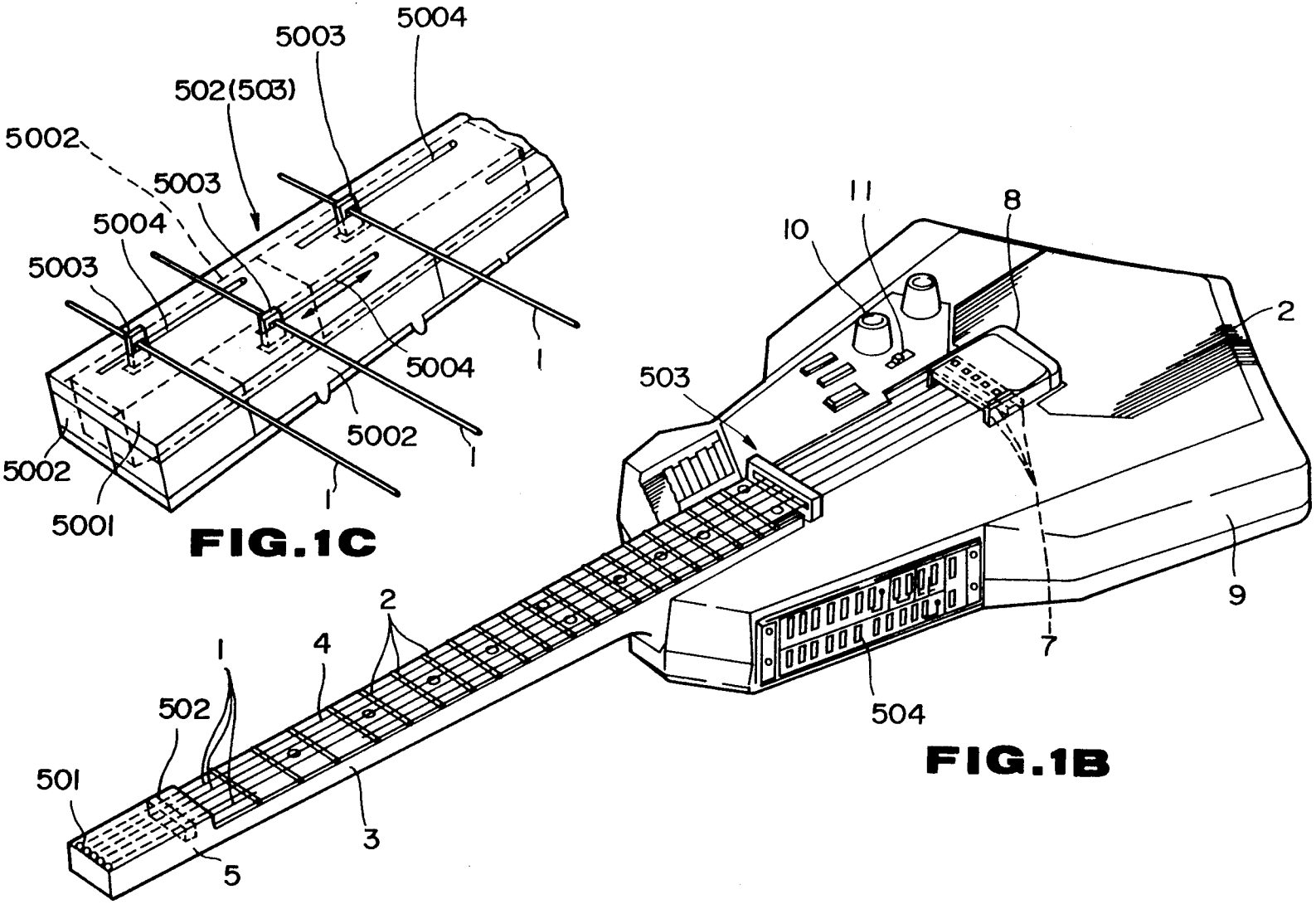
FIG. 1B is an external perspective view of an electronic stringed instrument.
FIG. 1C is a perspective view of a pitch bend detecting section.

FIG. 1A is a plan view and FIG. 1B is a perspective view of an electronic stringed instrument according to a first embodiment of the present invention.

The stringed instrument comprises a neck 3 with a fingerboard 4 and a body 9. Fingerboard 4 is partitioned by twenty frets 2 (#1 to #20) for specifying tone pitches.

Six inextensible strings 1 (#1 to #6) are stretched in parallel over fingerboard 4. Each of strings 1 has an end supported by a peg 501 on a head 5 and the other end supported by a bridge 6 in a pickup case 8 on body 9. When stopped between frets 2, each string will come into contact with the frets.

In pickup case 8 there is provided six pickups 7 (#1 to #6) for detecting triggering of corresponding strings 1. Pitch bend detectors 502 and 503 are provided inside head 5 and on the basal part of neck 3 that is attached to body 9, respectively.

The stringed instrument further comprises a power switch 11, a volume control 10 and a speaker 12 for emanating musical sounds.

In FIG. 1C there is illustrated in perspective of pitch bend detector 502 or 503 of FIGS. 1A and 1B.

Beneath upper plate 500 six slide type variable resistors 5002 are provided in positions corresponding to six strings 1. Each of strings 1 is supported by a slider 5003 which extends from a corresponding variable resistor and passes through a guide slot 5004 of upper plate 5001 to protrude from the upper plate.

When a player pushes up or down any string in the direction normal to the string while stopping the string in any position on fingerboard 4 during performance, that is, when the player performs a pitch bend operation (also called a choking operation), corresponding slider 5003 moves with the string so that corresponding variable resistor 5002 varies in its resistance. As a result, an amount of pitch bend is detected by a pitch bend detector to be described later and a musical sound being produced is controlled according to the detected amount of pitch bend.

Pitch bend detector 502 on head 5 is housed in head 5, while pitch bend detector 503 on the basal part of neck 3 is covered with a protective cover.

Figure 2A:
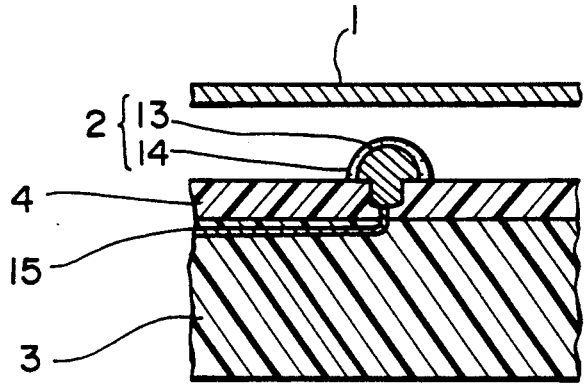
FIGS. 2A and 2B are diagrams illustrating the structure of a fret according to the first embodiment.
Figure 2B:
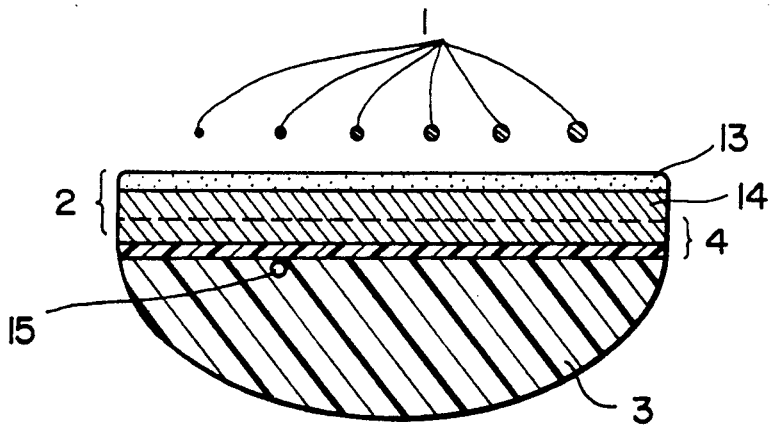

FIGS. 2A and 2B illustrate the structure of fret 2 of FIG. 1A or FIG. 1B. More specifically, FIG. 2A is a sectional view taken along line I—I of FIG. 1A and FIG. 2B is a sectional view taken along line II—II of FIG. 1A.

Fret 2 is common in structure to six strings 1 stretched in parallel over fingerboard 4 and embedded in a corresponding position of fingerboard 4 in the direction normal to the lengthwise direction of strings 1. Neck 3 and fingerboard 4 are formed of reinforced plastic. Alternatively they may be formed of an insulating material.

As shown in FIG. 2A, fret 2 has a structure in which a base member consisting of a conductor 14 (e.g. a metal) is coated with a resistance film 13. By being forced down to fingerboard 4, each string 1 is brought in contact with resistance film 13.

A lead 15 is connected to conductor 14 of fret 2. Lead 15 is further connected to a circuit, to be described later, which is installed in body 9 of FIG. 1A and FIG. 1B through a groove formed in neck 3 (the groove is formed at the center of the neck as is the case with usual guitars).

Figure 3:
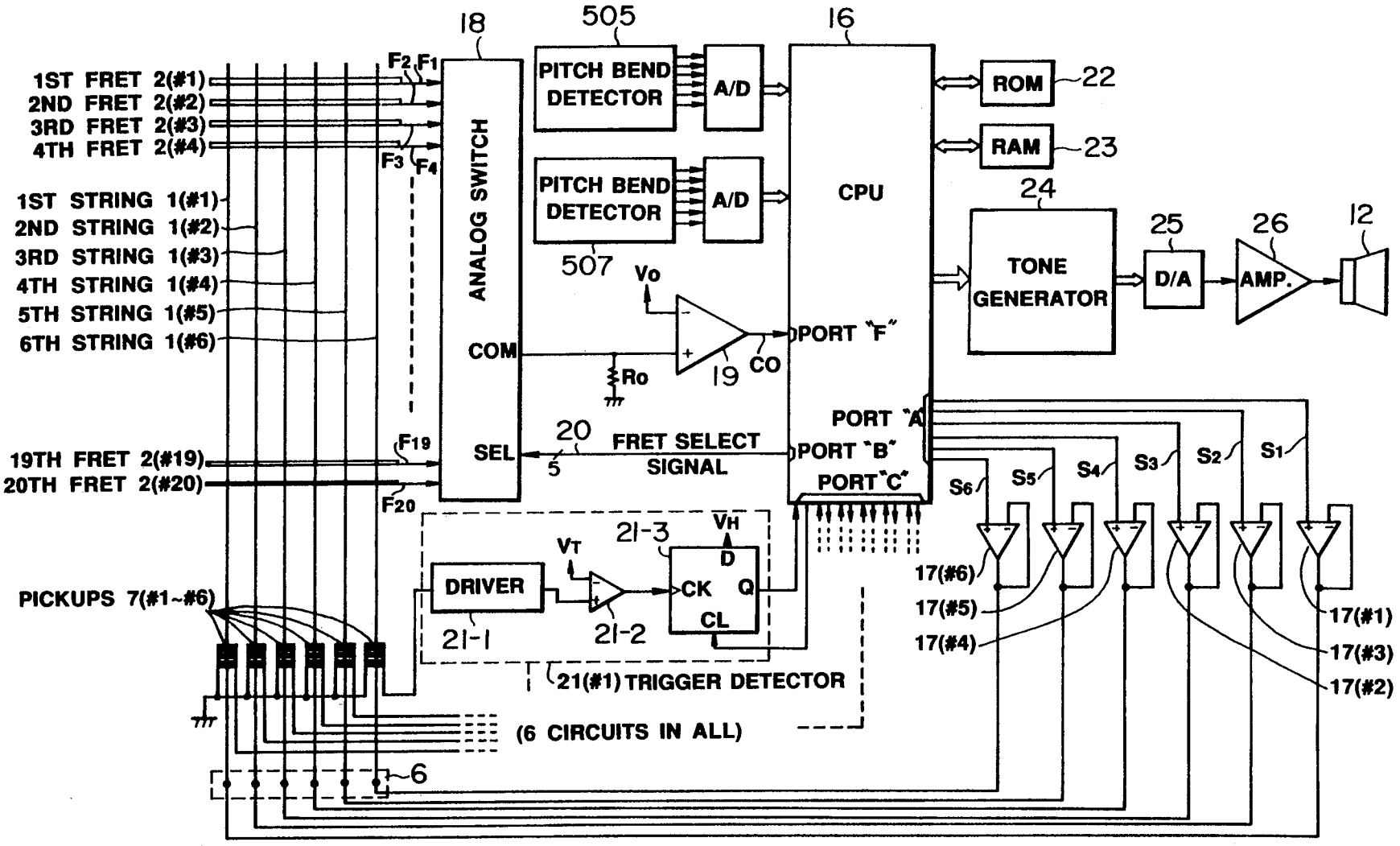
FIG. 3 is a block diagram illustrating the first embodiment.

FIG. 3 is a block diagram of electric system according to a first embodiment of an electronic stringed instrument constructed on the basis of the arrangements of FIGS. 1, 2A and 2B. The electric system is installed in body 8 shown in FIGS. 1A and 1B. Alternatively a tone generator 24, a D/A converter 25, an amplifier 26 and a loudspeaker 12 shown in FIG. 3 may be provided outside the instrument body of FIGS. 1A and 1B.

In FIG. 3, six voltage pulses S1 to S6 output from a port 'A' of a central processor unit (referred to as a CPU hereinafter) 16 are applied to noninverting inputs of six string drivers 17 (#1 to #6).

Each of string drivers 17 is formed of an operational amplifier with its output fed back to its inverting input. In the presence of an input signal, an output signal of each driver has the same polarity as the input signal. In the absence of an input signal, each driver has an extremely small output impedance of about 0.

Outputs of string drivers 17 (#1 to #6) are connected to the first (#1) through sixth (#6) strings 1, respectively, at bridge 6 (refer to FIG. 1A) so that voltage pulses S1 to S6 are applied to the corresponding strings 1.

Fret signals F1 to F20 obtained through leads 15 of the first (#1) through the twentieth (#20) frets 2 (omitted in FIG. 3; refer to FIGS. 2A and 2B) are applied to an analog switch circuit 18. Analog switch circuit 18 decodes a 5-bit fret select signal 20 (binary code) entered thereinto via its terminal SEL from a port 'B' of CPU 16 so as to select one out of fret signals F1 to F20, which is output from a common output terminal COM.

An output signal of analog switch circuit 18 is applied to a noninverting input of a comparator 19 formed of an operational amplifier to be compared with a threshold voltage Vo at its inverting input. Comparator 19 provides a fret detect signal Co which is applied to a port 'F' of CPU 16. The noninverting input of comparator 19 is pulled down to ground potential through resistor Ro.

Output signals of pickups 7 (#1–#6) which are respectively provided for strings 1 (#1–#6) are applied to six trigger detectors 21 (#1–#6; only #1 is illustrated).

In trigger detector 21, an output signal of pickup 7 is applied through a driver 21-1 to a noninverting input of comparator 21-2 to be compared with a threshold voltage Vt at its inverting input. When string 1 is picked and the output voltage of corresponding pickup 7 exceeds threshold voltage Vt, the output of comparator 21-2 goes to a high level.

The output of comparator 21-2 is coupled to a clock input CK of a D flip-flop 21-3, which is responsive to its clock input going high to provide a high-level potential VH of a logic 1 applied to its input terminal D from its output Q to a port 'C' of CPU 16 as a trigger detect signal indicating that a corresponding string has been picked. D flip-flop 21-3 is cleared by a clear signal which is applied to its clear terminal CL from port 'C' of CPU 16 at regular time intervals so that the picking of string 1 is detected repeatedly.

As described above, head 5 is provided with pitch bend detector 502 which has six slide type variable resistors 5002 corresponding to six strings 1 (#1–#6). Those resistors 5002 are connected to a pitch bend detect circuit 505 of FIG. 3 so that the moved distance of slider 5003 of each of variable resistors 5002 is converted to a voltage value. The voltage value is converted by an A/D converter 506 to digital data for application to CPU 16.

Similarly, in pitch bend detector 503 installed in that basal part of neck 3 which is attached to body 9, six slide type variable resistors 5002 are connected to a pitch bend detect circuit 507 of FIG. 3. Voltage values from pitch bend detect circuit 507 are converted by an A/D converter 508 to digital data for application to CPU 16.

A read only memory (ROM) 22 and a random access memory (RAM) 23 are connected to CPU 16. ROM 22 stores programs for control operations to be described later, and RAM 23 serves as a work area for the programs and as a directory area for musical sound information for user.

CPU 16 provides tone control information to be described later, such as tone generation initiating information, pitch specifying information and pitch altering information, to tone generator 24. Tone generator 24 produces musical tone signals which are converted by a D/A converter 25 to analog musical tone signals which are amplified by an amplifier 26 and then sounded by a speaker 12.

Operation of First Embodiment

Figure 4:
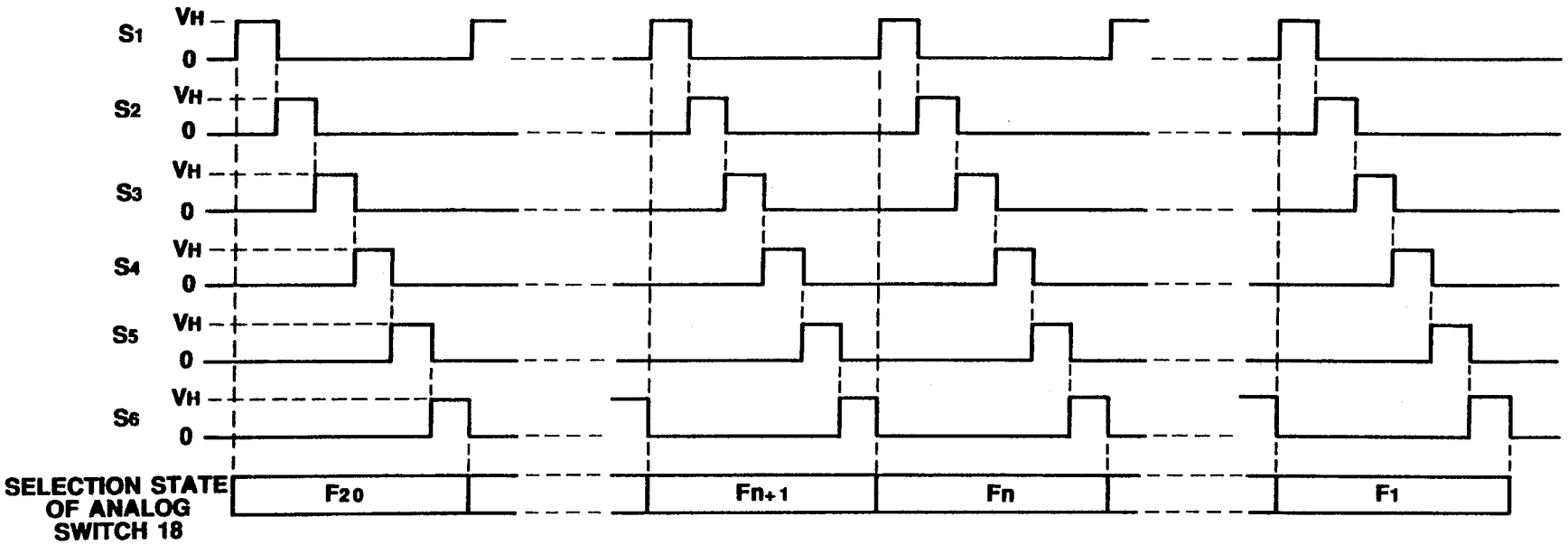
FIG. 4 is a timing chart for the basic operation of the first embodiment.

Voltage pulses S1 to S6 output from port 'A' of CPU sequentially go to a high level potential VH of logic as shown in FIG. 4. The 5-bit fret select signal 20 output from port 'B' of CPU 16 varies at regular intervals during each of which voltage pulses S1 to S6 are produced so that analog switch circuit 18 selects the fret signals in sequence from fret signal F20 to fret signal F1 as shown in FIG. 4.

Suppose now that the first string (#1) and the second string (#2) are stopped to come into contact with the n-th fret (#n) and analog switch circuit 18 selects fret signal Fn from the n-th fret (#n) in FIG. 4.

Figure 5A:
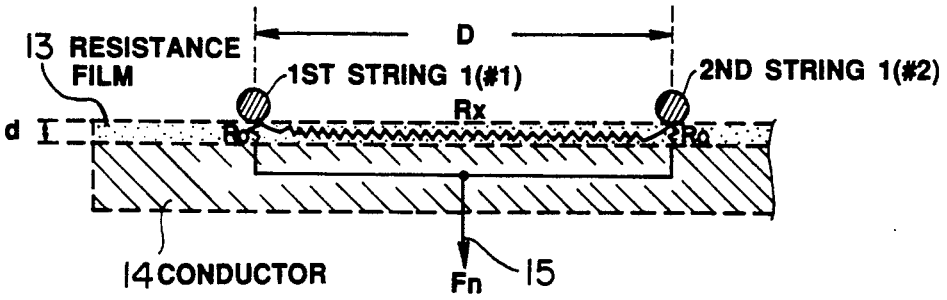
FIGS. 5A-5C are diagrams illustrating an equivalent circuit of the first embodiment in the case where the first and second strings contact to each other at the n-th fret.

In this case, an equivalent circuit associated with the n-th fret (#n) will be shown as in FIG. 5A. That is, since each of the first and second strings contact resistance film 13, there is a resistance of Ro corresponding to the thickness d of the resistance film between conductor 14 and each of the first and second strings (refer to FIGS. 2A and 2B as well). Between the first and second strings is also a resistance of Rx in resistance film 13 which corresponds to the distance D between the first and second strings Moreover, the noninverting input of comparator 19 is pulled down to ground potential by a resistor of a resistance of Ro.

Figure 5B:
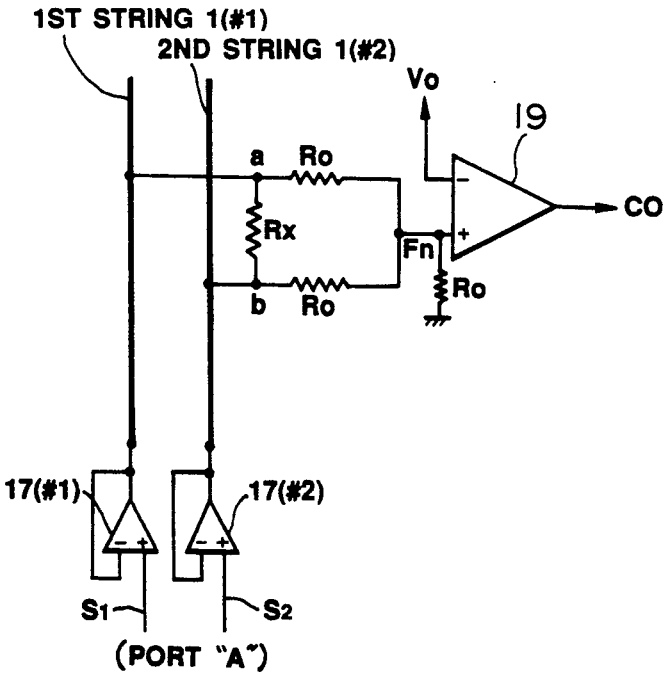

Therefore, the system equivalent circuit associated with the first and second strings will be depicted as shown in FIG. 5B. It is to be noted here that the thickness d of resistance film 13 of FIG. 5A can be made very small compared with the interstring distance D by coating conductor 14 with resistance film 13 in manufacturing fret 2. Since, in this case, the resistance Rx is very large compared with the resistance Ro, the first and second strings may be considered to be substantially electrically insulated from each other in FIG. 5A. That is, resistance Rx may be excluded from the equivalent circuit of FIG. 5B so that an approximately open state is created between terminals a and b.

Figure 5C:
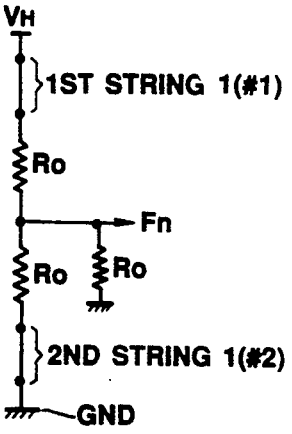

When, therefore, voltage pulse S1 goes to a high level potential VH during an interval in which analog switch circuit 18 of FIG. 4 selects fret signal Fn from the n-th fret 2 (#2), the equivalent circuit will be given as shown in FIG. 5C. Here the connection to ground GND is due to the fact that the output impedance of string driver 17 (#2) connected to the second string (#2) is about zero. Note that, at this point, voltage pulse S2 is not applied. The part where fret signal Fn is detected is regarded as open as shown in FIG. 5C because the input impedance of comparator 19 connected via analog switch 18 of FIG. 3 is very large.

Figure 6:
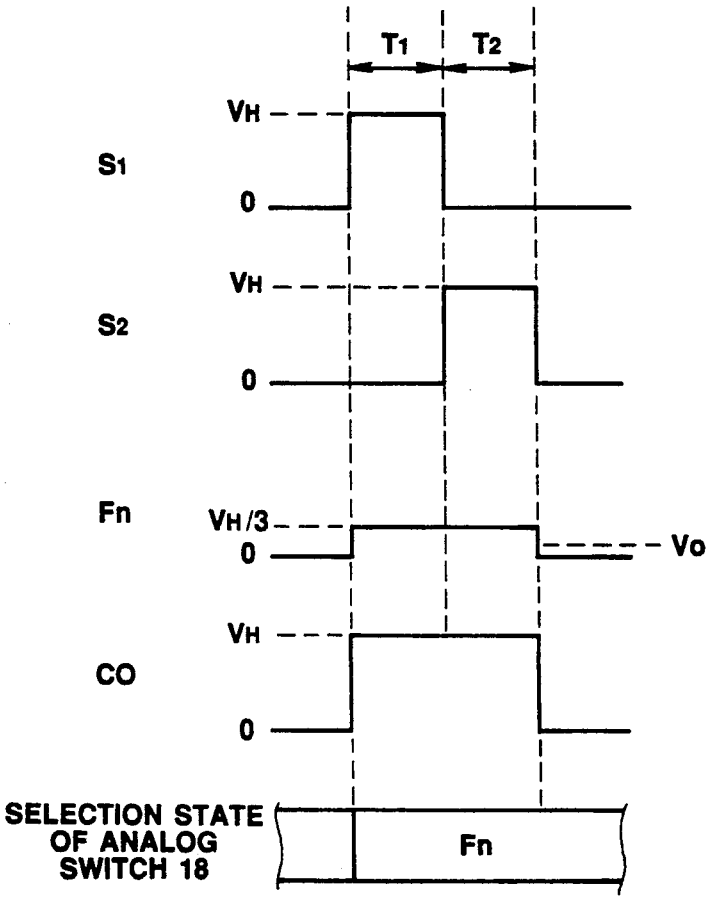
FIG. 6 is a timing chart for the operation of the first embodiment in the case where the first and second strings contact each other at the n-th fret.

From the equivalent circuit of FIG. 5C, $Fn = VH \times (Ro/2)/(Ro + Ro/2) = VH/3$. When voltage pulse S1 goes to high level potential VH during the interval in which analog switch circuit 18 selects fret signal Fn from the n-th fret 2 (#n), that is, during an interval T1 shown in FIG. 6, fret signal Fn becomes VH/3 as shown. If, therefore, threshold voltage Vo applied to comparator of FIG. 3 is set to a positive potential lower than VH/3, comparator 19 can provide fret detect output Co of high level potential VH corresponding to logic 1 during interval T1 as shown in FIG. 6.

At this point CPU 16 can recognize that analog switch circuit 18 now selects fret signal Fn according to the state of fret select signal 20, and voltage pulse S1 is at high level potential VH. Hence CPU 16 can detect a string stopped state, in which the first string (#1) is in contact with the n-th fret (#n), at a time when fret detect output Co goes to the high level potential VH. At the same time, CPU 16 recognizes that trigger detect circuit 21 (#1) has detected the initiation of picking of the first string (#1) and provides tone generation initiating information and tone pitch information of the first string corresponding to the n-th fret to tone generator 24. Tone generator 24 can, therefore, initiate the generation of a musical tone signal at the specified pitch.

Next, suppose that voltage pulse S2 goes to high level potential VH during the interval when analog switch circuit 18 selects fret signal Fn from the n-th fret (#n) with the first and second strings in contact with the n-th fret. The equivalent circuit in this case is such that the first and second strings of FIG. 5C have only to be replaced with each other. Therefore, fret signal Fn becomes VH/3 and fret detect output Co of comparator 19 goes to high level potential VH in an interval of T2 of FIG. 6 as well.

Accordingly CPU 16 can recognize a string stopped state in which the second string (#2) is in contact with the n-th fret (#n) on the basis of a combination of fret signal Fn and voltage pulse S2. And moreover CPU 16 recognizes that trigger detect circuit 21 (#2) not shown in FIG. 3 has detected the initiation of picking of the second string (#2) and thus provides tone generation initiating information and tone pitch information of the second string (#2) defined by the n-th fret (#2) to tone generator 24.

The reason why the noninverting input of comparator 19 is pulled down to ground potential by resistance Ro in FIG. 3 is to prevent the potential at the noninverting input of comparator 19 from becoming indefinite in case where no string comes into contact with any of the frets (#1-#20) when they are selected in sequence by analog switch circuit 18. In such case the noninverting input of comparator 19 can be kept at ground potential by connection to ground via resistance R0, thus preventing malfunction.

A description will now be given of how to set the threshold voltage Vo of comparator 19 of FIG. 3.

Figure 7:
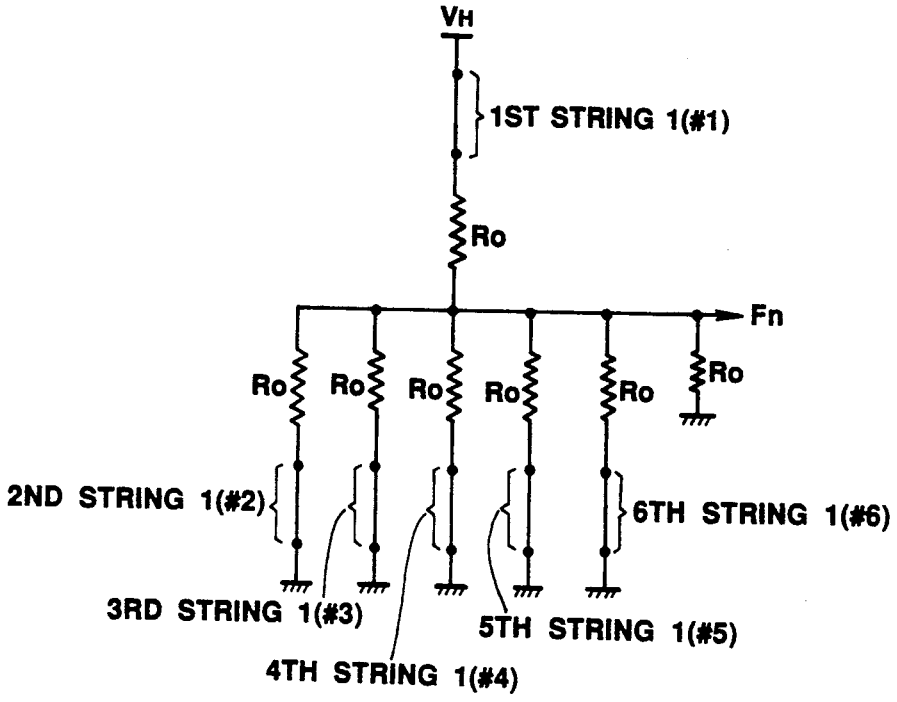
FIG. 7 is a diagram illustrating an equivalent circuit of the first embodiment in the case where all the strings contact to one another.

When all the strings (#1-#6) are in contact with, for example, the n-th fret (#n) and moreover voltage pulse S1 of high level potential VH is applied to the first string (#1), the equivalent circuit associated with fret signal Fn from the n-th fret (#n) will be depicted as shown in FIG. 7. In this case, Fn will be $Fn=VH(Ro/6)/\{Ro+(Ro/6)\}=VH/7$. It is in this case that the potential of fret signal Fn detected when the first string (#1) is in contact with the n-th fret (#n) becomes lowest.

In order for fret detect output Co of comparator 19 of FIG. 3 to go to the high level potential VH of logic 1 in that case as well, therefore, the threshold voltage Vo of comparator 19 has only to be set such that $VH/7>Vo>0$.

Figure 31:
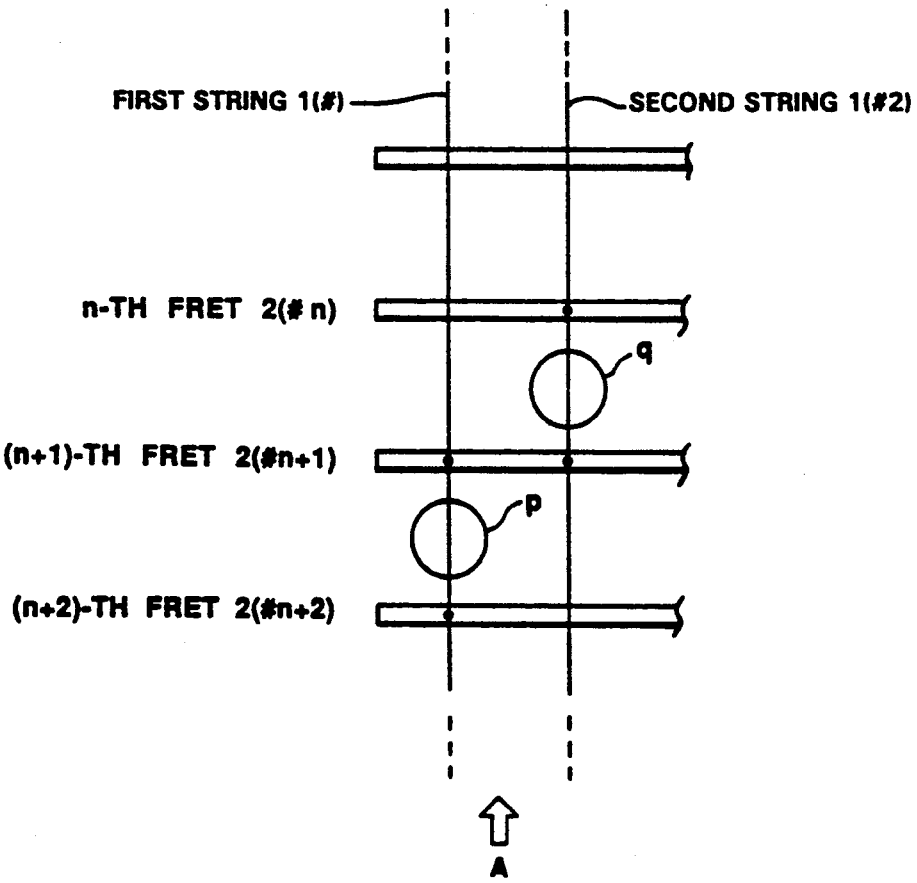
FIG. 31 is a diagram illustrating an example of strings being pressed.

Next, a description will given of the operation of the circuit of FIG. 3 when the first and second strings are stopped as indicated at p and q in FIG. 31. In this case CPU 16 is required to detect that the first string (#1) is in contact with the (n+1)-th fret 2 (#n+1) and the (n+2)-th fret 2 (#n+2) and the second string 1 (#2) is in contact with the n-th fret 2 (#n) and the (n+1)-th fret 2 (#n+1).

Figure 8:
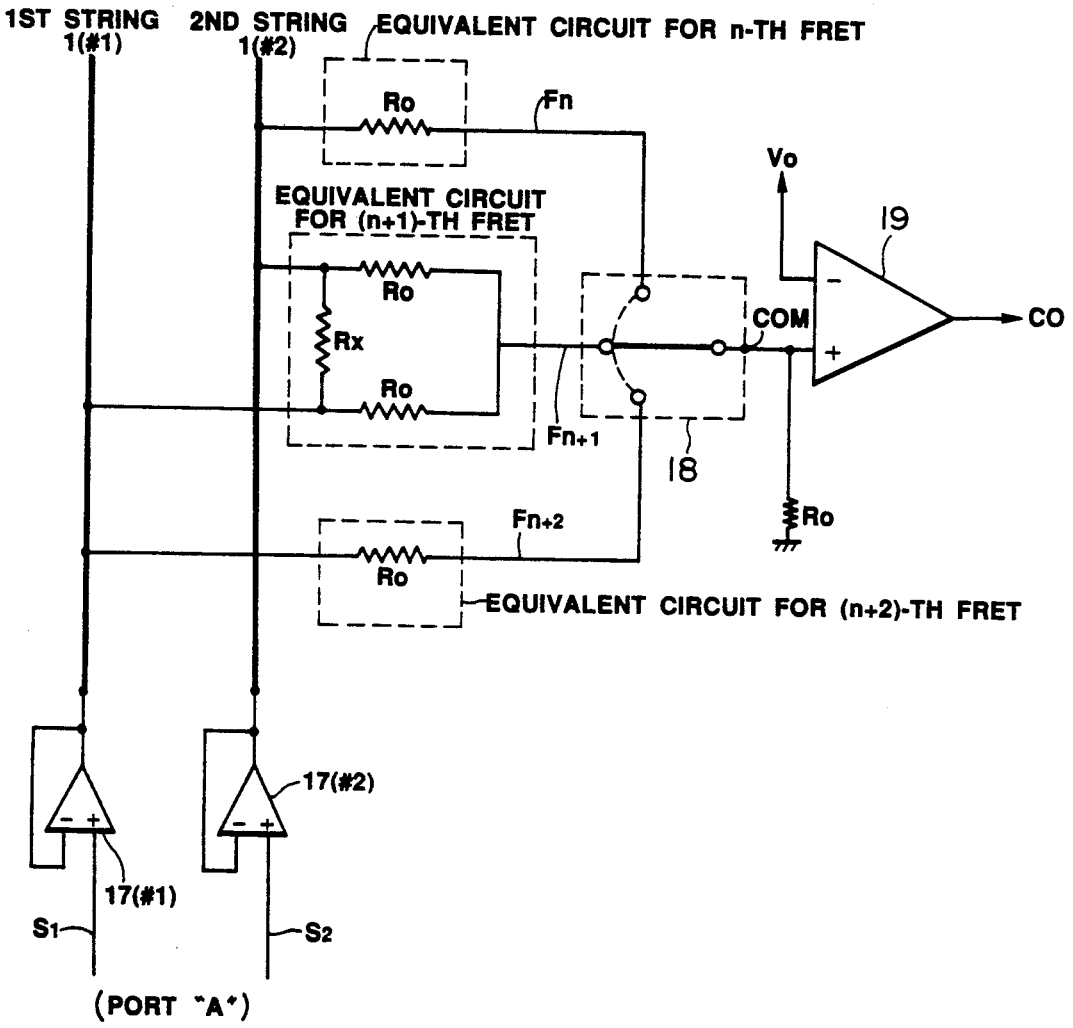
FIG. 8 is a diagram illustrating an equivalent circuit of the first embodiment in the case shown in FIG. 31.

An equivalent circuit of FIG. 3 for the state of FIG. 31 in an interval when analog switch circuit 18 selects fret signal Fn+2, Fn+1 or Fn (refer to FIG. 4) will be depicted like FIG. 8 in the same manner as in the case of FIGS. 5A to 5C. Resistance Rx may be excluded in this case as well.

Figures 9A, 9B, 9C, 9D, 9E:
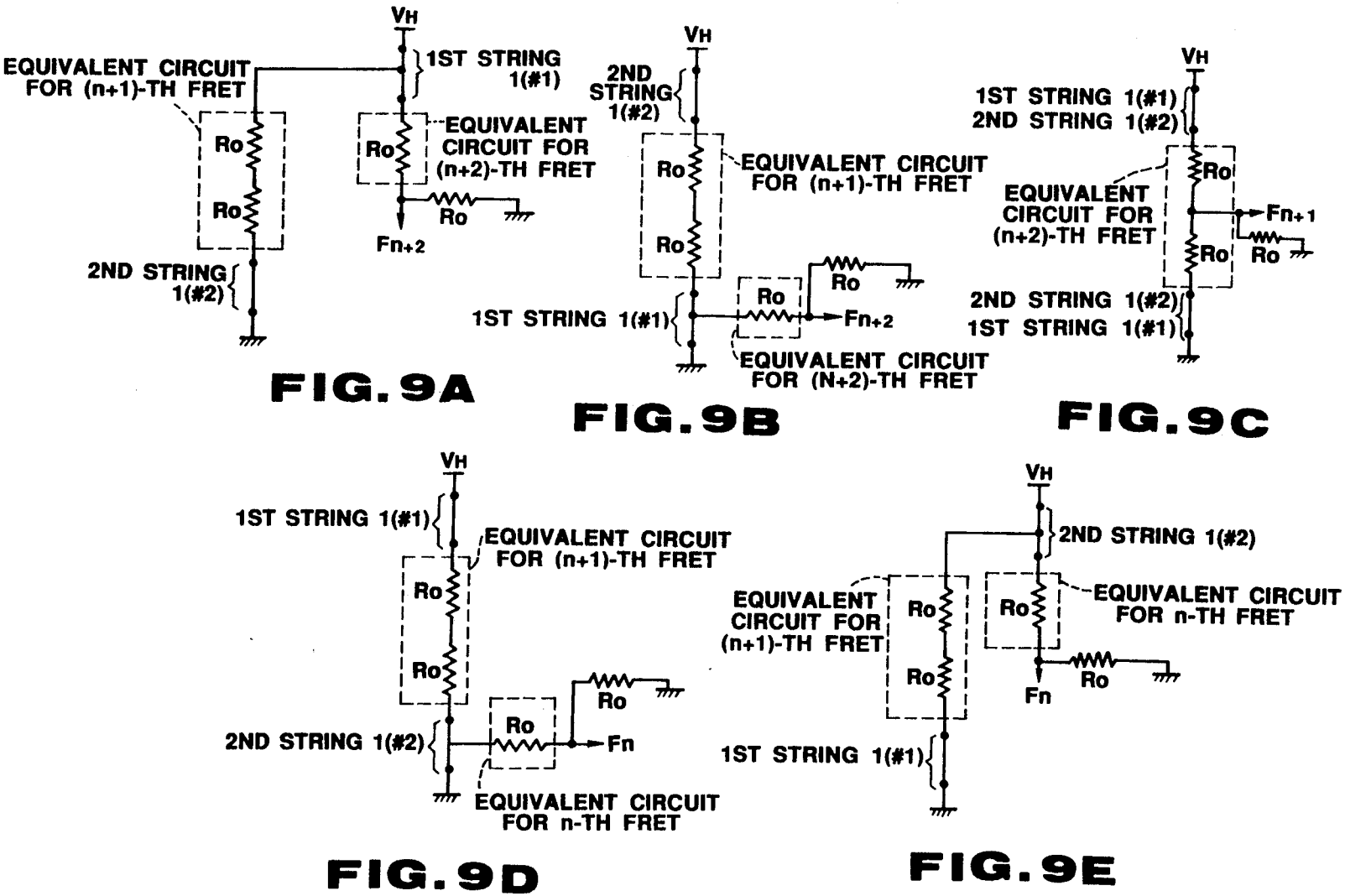
FIGS. 9A to 9E are diagrams illustrating an equivalent circuit of the first embodiment in operation in the case shown in FIG. 31 or 8.
Figure 10:
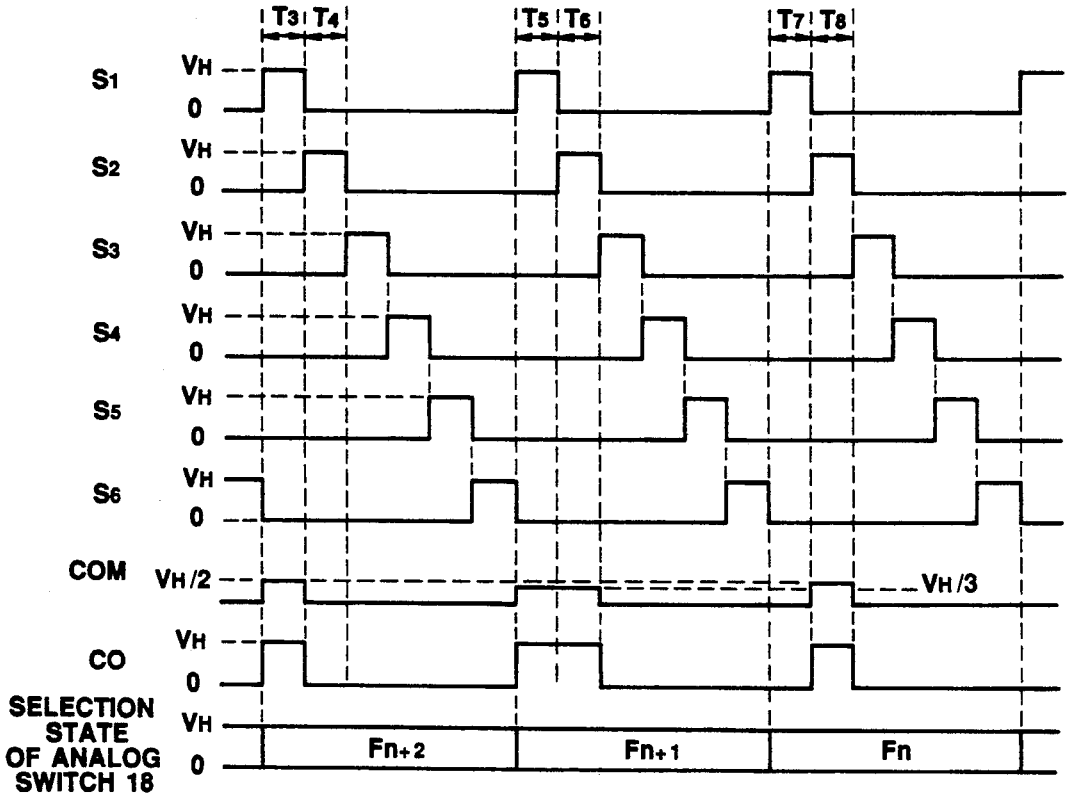
FIG. 10 is a timing chart for the operation of the first embodiment in the case shown in FIG. 31.

Equivalent circuits when voltage pulse S1 or S2 is raised during an interval when analog switch circuit 18 selects fret signal Fn+2, Fn+1 or Fn, that is, for intervals T3, T4, T5, T6, T7 and T8 of FIG. 10 are shown in FIGS. 9A to 9E.

First, FIG. 9A shows an equivalent circuit for interval T3 of FIG. 10 when analog switch 18 selects the fret signal Fn+2 from the (n+2)-th fret 2 (#n+2) and voltage pulse S1 is applied to the first string 1 (#1). In this case fret signal Fn+2 from common output terminal COM of analog switch 18 will be $Fn+2=VH/2$ because the input impedance of comparator 19 is very high and hence no current flows thereinto. As a result, fret detect output CO of comparator 19 goes to the high level potential VH as shown in FIG. 10. CPU 16 can, therefore, detect that the first string (#1) is in contact with the (n+2)-th fret (#n+2).

FIG. 9B shows an equivalent circuit for interval T4 of FIG. 10 when analog switch 18 selects the fret (#2) is fed with voltage pulse S2. In this case the fret signal Fn+2 from common output terminal COM of analog switch 18 becomes ground potential (0 volts). Fret detect output CO of comparator 19 is therefore at the low level potential (0 volts) corresponding to logic 0 as shown in FIG. 10. It can be seen that the second string (#2) is not in contact with the (n+2)-th fret (#n+2) as indicated in FIG. 31.

FIG. 9C shows an equivalent circuit for interval T5 of FIG. 10 when analog switch 18 selects fret signal Fn+1 from the (n+1)-th fret (#n+1) and the first string (#1) is supplied with voltage pulse S1. In this case fret signal Fn+1 from common output terminal COM of analog switch 18 will be $Fn+1=VH(Ro/2)/(Ro+Ro/2)=VH/3$. Hence fret detect output CO of comparator 19 goes to high level potential VH as shown in FIG. 10. This will allow CPU 16 to recognize that the first string is in contact with the (n+1)-th fret as indicated in FIG. 31.

In interval T6 of FIG. 10 when analog switch 18 selects fret signal Fn+1 from the (n+1)-th fret and the second string is fed with voltage pulse S2, fret signal Fn+1 from common output terminal of analog switch 18 will be $Fn+1=VH/3$. This is because the equivalent circuit for interval T6 is the same as that for interval T5 except that the first and second strings are replaced with each other as indicated in brackets in FIG. 9C. In this case, therefore, fret detect output CO of comparator 19 goes to high level potential VH as shown in FIG. 10, thus allowing CPU 16 to recognize that the second string is in contact with the (n+1)-th fret as in FIG. 31.

FIG. 9D shows the equivalent circuit for interval T7 of FIG. 10 when analog switch 18 selects fret signal Fn from the n-th fret and voltage pulse S1 is applied to the first string. In this case fret signal Fn output from common output terminal COM of analog switch 18 is at ground potential (0 volts). Hence, fret detect output CO of comparator 19 is at the low level potential (0 volts) corresponding to logic 0 as shown in FIG. 10. It can be seen that the first string is not in contact with the n-th fret as in FIG. 31.

Finally, FIG. 9E shows the equivalent circuit for interval T8 of FIG. 10 when analog switch 18 selects fret signal Fn from the n-th fret and the second string is fed with voltage pulse S2. Fret signal Fn from common output terminal COM of analog switch 18 will be $Fn=VH/2$. Hence, fret detect output CO from comparator 19 is at the high level potential VH as shown in FIG. 10, thus allowing CPU 16 to detect that the second string is in contact with the n-th fret.

As described above with reference to FIGS. 8 to FIG. 10, even in such an example of string stopped state as shown in FIG. 31, the problem with the fourth conventional example that, when a signal is applied to the second string, the signal is erroneously detected from the (n+2)-th fret via the (n+1)-th fret and the first string can be avoided. CPU 16 can, therefore, detect accurate positions in which strings are stopped.

In FIG. 31, assuming that an arrow A is directed toward bridge 6 of FIG. 1A, the pitch of each of the first and second strings is defined by the fret which is nearer to bridge 6. In order to recognize the fret which is nearest to the bridge for each string, therefore, CPU 16 sequentially scans the frets (#1-#20) starting with the twentieth fret (#20) which is nearest to the bridge 6 among 20 frets. In the example of FIG. 31, therefore, the first string (#1) is detected during interval T3 of FIG. 10 but not during following intervals T5 and T7, whereas the second string (#2) is detected during interval T6 but not during following interval T8.

Next, a description will given of a pitch bend operation by a player succeeding the detection by the CPU of the position of a fret at which a string is stopped by the player.

As described above, the pitch bend operation is a performance operation in which the player pushes up a string in the direction normal thereto while stopping it on the fingerboard. When this operation is performed on a normal guitar, the tension of a string varies. By picking up and amplifying the variations of tension, it is possible to vary the pitch of a musical sound being sounded from the original pitch defined by the stopped position of the string. The electronic guitar according to the present embodiment can also add the pitch bend effect to musical sounds by the following operations.

That is, when the player performs the pitch bend operation on a string, a corresponding slider 5003 (FIG. 1C) moves with the movement of the string in pitch bend detectors 502 and 503 (FIGS. 1A and 1B). As a result, a corresponding variable resistor 5002 (FIG. 1C) varies its resistance.

The resistance variation is converted to a corresponding voltage value in pitch bend detectors 505 and 507 of FIG. 3 and then converted to a digital value by A/D converters 506 and 508 for application to CPU 16.

CPU 16 calculates a mean value of the digital values from A/D converters 506 and 508 for each of strings and further calculates the variation of the mean value from the corresponding mean value obtained when tone generation is initiated (at a point of time when the picking of the corresponding string is detected by trigger detector 21 of FIG. 3).

CPU 16 calculates the variation of the tone pitch corresponding to the variation of the mean value to prepare corresponding pitch variation information, which is entered into tone generator 24. Tone generator 24 is responsive to the pitch variation information to vary the pitch of a musical sound being produced.

As can be seen from FIGS. 1A and 1B, the pitch bend control is performed by use of two pitch bend detectors 502 and 503. This is to stably detect the pitch bend quantity, no matter where a string may be stopped on fingerboard 4. That is, if a pitch bend detector were provided only on the side of head 5, the pitch bend quantity based on a pitch bend operation at a fret for higher pitch (a fret nearer to bridge 6) could not be detected stably by the detector. This is because the amount of movement of a string due to the pitch bend operation is very small on the side of head 5.

Adjacent strings can come close to each other abnormally when a pitch bend operation is performed. In this case, the thickness d of resistive film 13 cannot be very small as compared with the distance D between the adjacent strings. For this reason, there is a possibility that resistance Rx cannot be sufficiently large as compared with resistance Ro so that resistance Rx cannot be excluded from the equivalent circuit of FIG. 5B. In general, however, the pitch bend operation is seldom performed simultaneously with the string stopping operation, and moreover the string stopping operation is usually performed while keeping normal string spacing. Thus, no problem will arise. As a countermeasure against abnormal approach of one string to another, CPU 16 can perform on a software basis such a control operation as to perform fret detection only at a time of detection of picking of a corresponding string by trigger detector 21 of FIG. 3 and thereafter perform no fret detection with respect to the string until it stops vibrating (until trigger detector 21 becomes unable to detect picking of the string).

There is also a possibility that strings touch each other at a time of pitch bend operation after initiation of tone generation to cause a malfunction. The above software control by CPU 16 will solve this problem in this case as well.

Block Diagram of Second Embodiment

Figure 11:
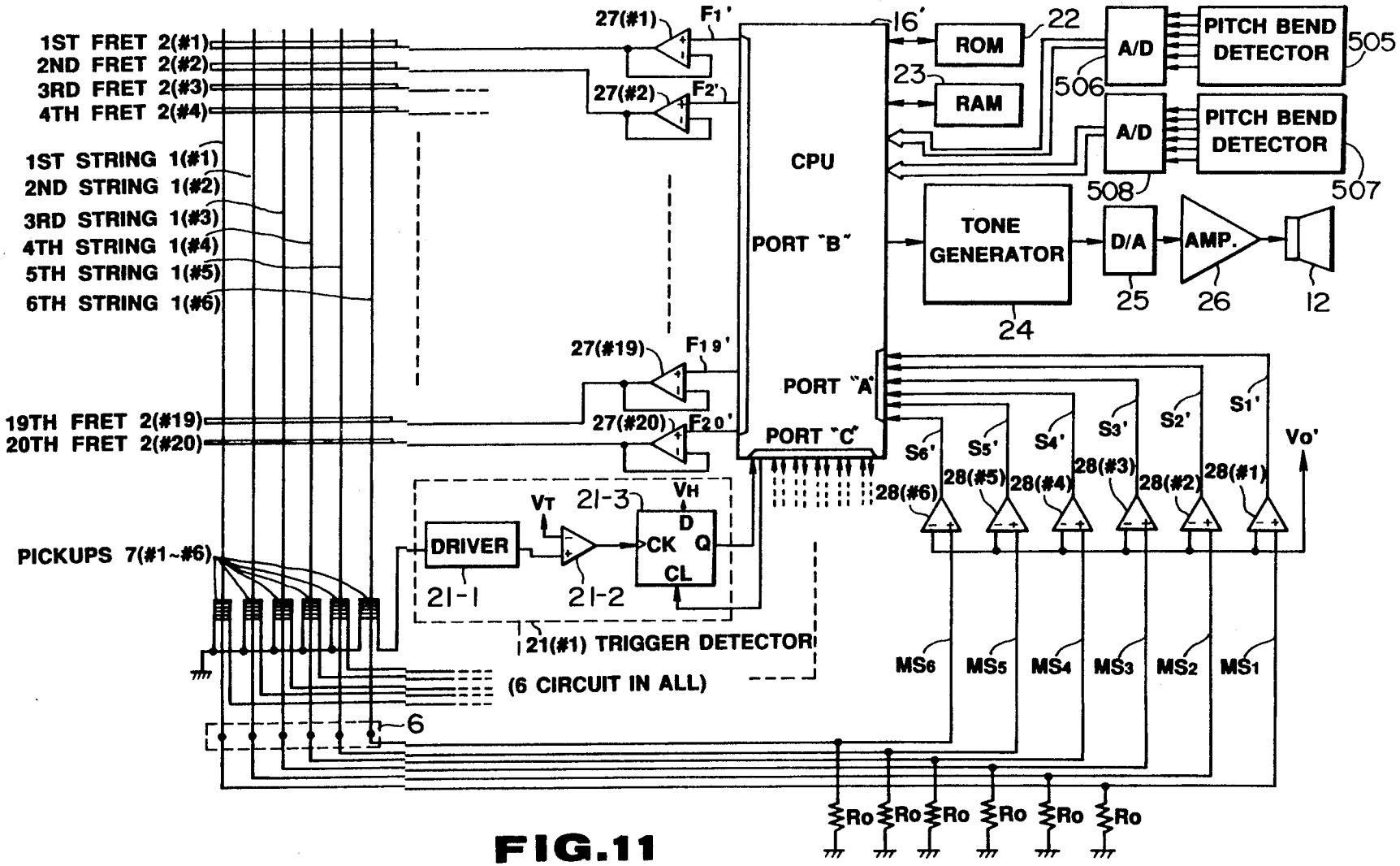
FIG. 11 is a block diagram of the second embodiment.

FIG. 11 is a block diagram of a second embodiment of the electronic stringed instrument of the present invention. The overall structure of the instrument body is the same as that shown in FIGS. 1A to 1C. and the structure of the fret is also exactly the same as that shown in FIGS. 2A and 2B. FIG. 11 corresponds to FIG. 3 but different from the first embodiment of FIG. 3 in that the voltage pulses are applied to frets 2 so as to be detected from the strings on the side of bridge 6.

In FIG. 11, voltage pulses F1' to F20' output from port 'B' of CPU16' are respectively applied to noninverting input terminals of 20 fret drivers 27 (#1 to #20).

Each of fret drivers 27 is formed of an operational amplifier with its output fed back to its inverting input terminal. Signals which are the same as voltage pulses F1' to F20' appear at the outputs of the fret drivers. In the absence of an input signal, each fret driver has an output impedance of about zero.

The outputs of fret drivers 27 (#1-#20) are connected to first (#1) to twentieth (#20) frets 2, respectively, via leads 15 (omitted in FIG. 11; refer to FIGS. 2A and 2B).

On the other hand, string signals MS1 to MS6 output from first (#1) to sixth (#6) strings 1 on the side of bridge 6 (refer to FIG. 1A) are applied to noninverting input terminals of comparators 28 (#1 to #6) each formed of an operational amplifier and compared with threshold voltages Vo' at their inverting input terminals to provide string detect outputs S1' to S6' for application to port 'A' of CPU 16'. Each of comparators 28 has its inverting input terminal pulled down to ground potential by a resistor with a resistance of Ro. As in the first embodiment, this is to prevent the inverting input terminal of each comparator from becoming indefinite in potential in a case where each string is not in contact with any fret. Because of the resistor the inverting input terminal of each comparator can be kept at ground potential in such a case. Otherwise, malfunction might occur.

In FIG. 11, like reference characters are used to designate other circuits corresponding to those used in the first embodiment of FIG. 3 and description thereof is omitted.

Operation of Second Embodiment

Figure 12:
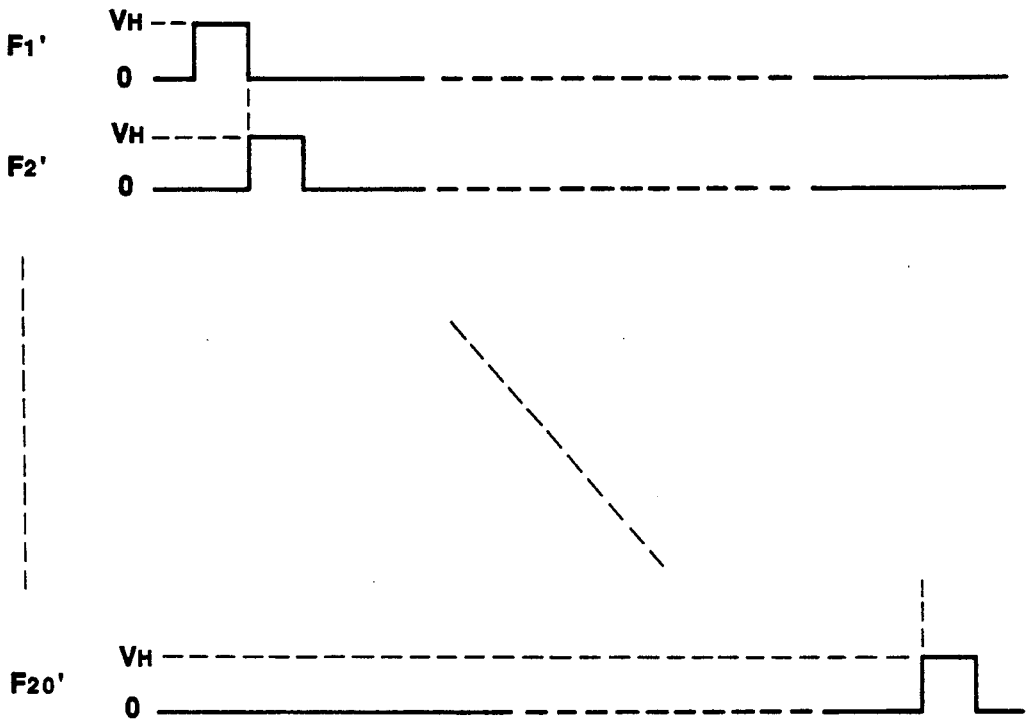
FIG. 12 is a timing chart for the basic operation of the second embodiment.

First, voltage pulses F1' to F20' output from port 'B' of CPU 16' sequentially go to high level potential VH corresponding to logic 1 as shown in FIG. 12. CPU 16' decides string detect outputs S1' to S6' each time one of the voltage pulses is generated.

The operation of the circuit of FIG. 11 will now be described with respect to the case where the first and second strings are stopped as indicated at p and q in FIG. 31.

Figure 13:
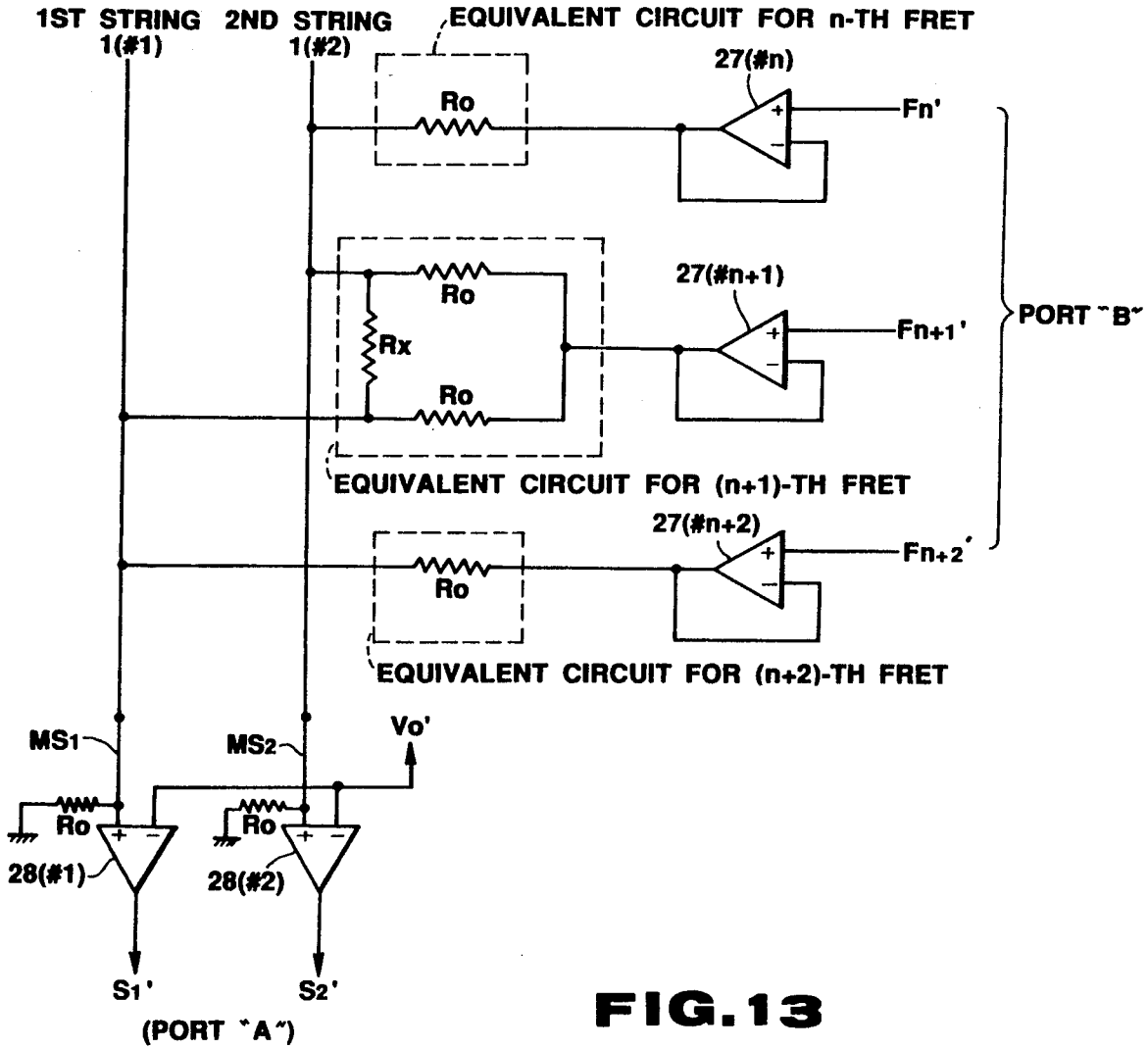
FIG. 13 is a diagram illustrating an equivalent circuit of the second embodiment in the case shown in FIG. 31.
Figure 14A:
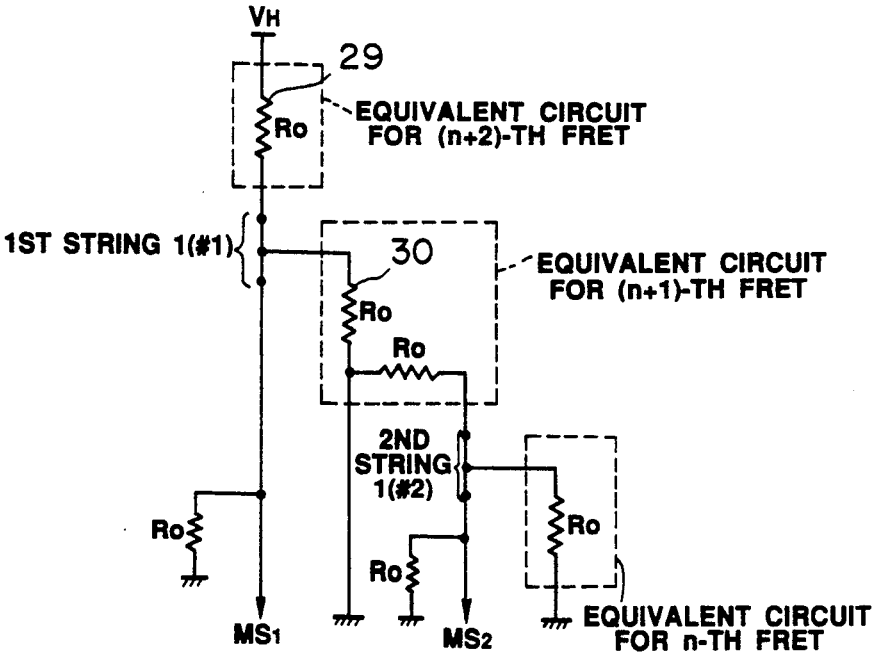
FIGS. 14A to 14C are diagrams illustrating an equivalent circuit of the second embodiment in operation in the case shown in FIG. 31 or 13.
Figure 14B:
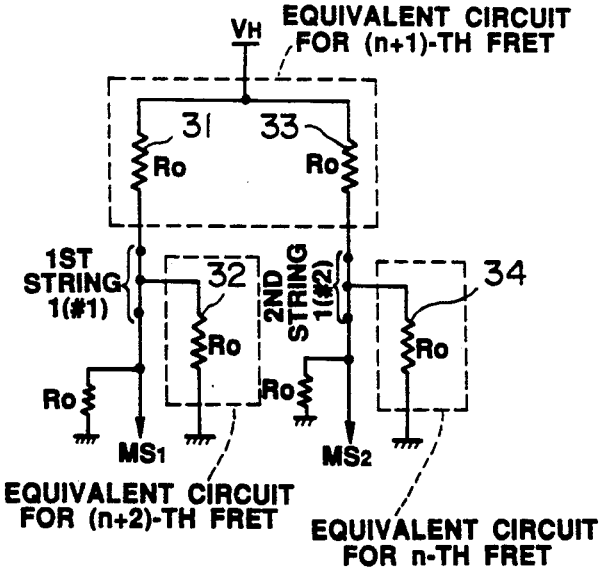
Figure 14C:
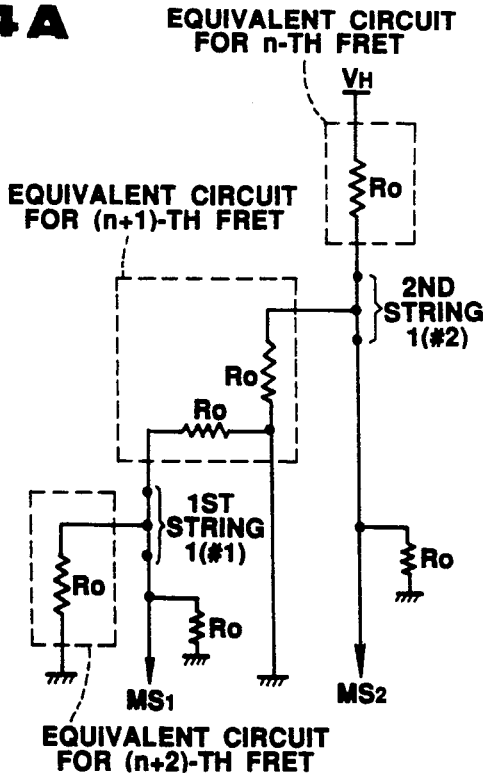
Figure 15:
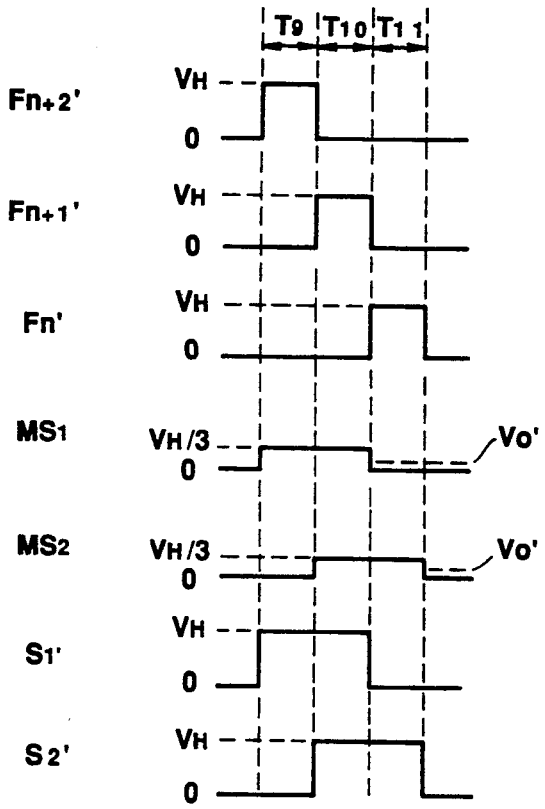
FIG. 15 is a timing chart for the operation of the second embodiment in the case shown in FIG. 31.

In this case, the equivalent circuit of the circuit of FIG. 11 in the case where voltage pulse Fn+2', Fn+1' or Fn' is raised to VH in FIG. 12, that is, in the case of interval T9, T10 or T11 shown in FIG. 15 will be shown as in FIG. 13, as in the case of FIGS. 5A to 5C or 8 in the first embodiment. Again, resistance Rx can be excluded. The equivalent circuits for intervals T9, T10 and T11 are shown in FIGS. 14A to 14C.

First, FIG. 14A shows the equivalent circuit for interval T9 of FIG. 15 in which voltage pulse Fn+2 is applied to the (n+2)-th fret 2. In this case string signal MS1 from the first string of FIG. 11 becomes a potential obtained by dividing high level potential VH and ground potential (0 volts) with resistances 29 and 30 and pulldown resistance Ro, namely, MS1=VH(Ro/2)/(Ro+Ro/2)=VH/3. Hence, string detect output S1' of comparator 28 (#1) of FIG. 11 goes to VH as shown in FIG. 15 so that CPU' of FIG. 16 recognizes that the first string is, in contact with the (n+2)-th fret as shown in FIG. 31.

In the same interval T9, on the other hand, string signal MS2 from the second string becomes ground potential (0 volts) as can be seen from FIG. 14A. String detect output S2' of comparator 28 (#2) is, therefore, at a low level potential (0 volts) corresponding to logic 0 as shown in FIG. 15. Consequently it can be seen that the second string is not in contact with the (n+2)-th fret.

Next, FIG. 14B shows the equivalent circuit for interval T10 of FIG. 15 in which voltage pulse Fn+1 is applied to the (n+1)-th fret. In this case string signal MS1 from the first string of FIG. 11 becomes a potential obtained by dividing high level potential VH and ground potential (0 volts) with resistances 1 and 32 and pulldown resistance Ro, i.e., MS1=VH(Ro/2)/(Ro+Ro/2)=VH/3. Hence, string signal output S1' of comparator 28 (#1) is raised to VH as shown in FIG. 15. Consequently, CPU 16' recognizes that the first string is in contact with the (n+1)-th fret as shown in FIG. 31.

Figure 16:
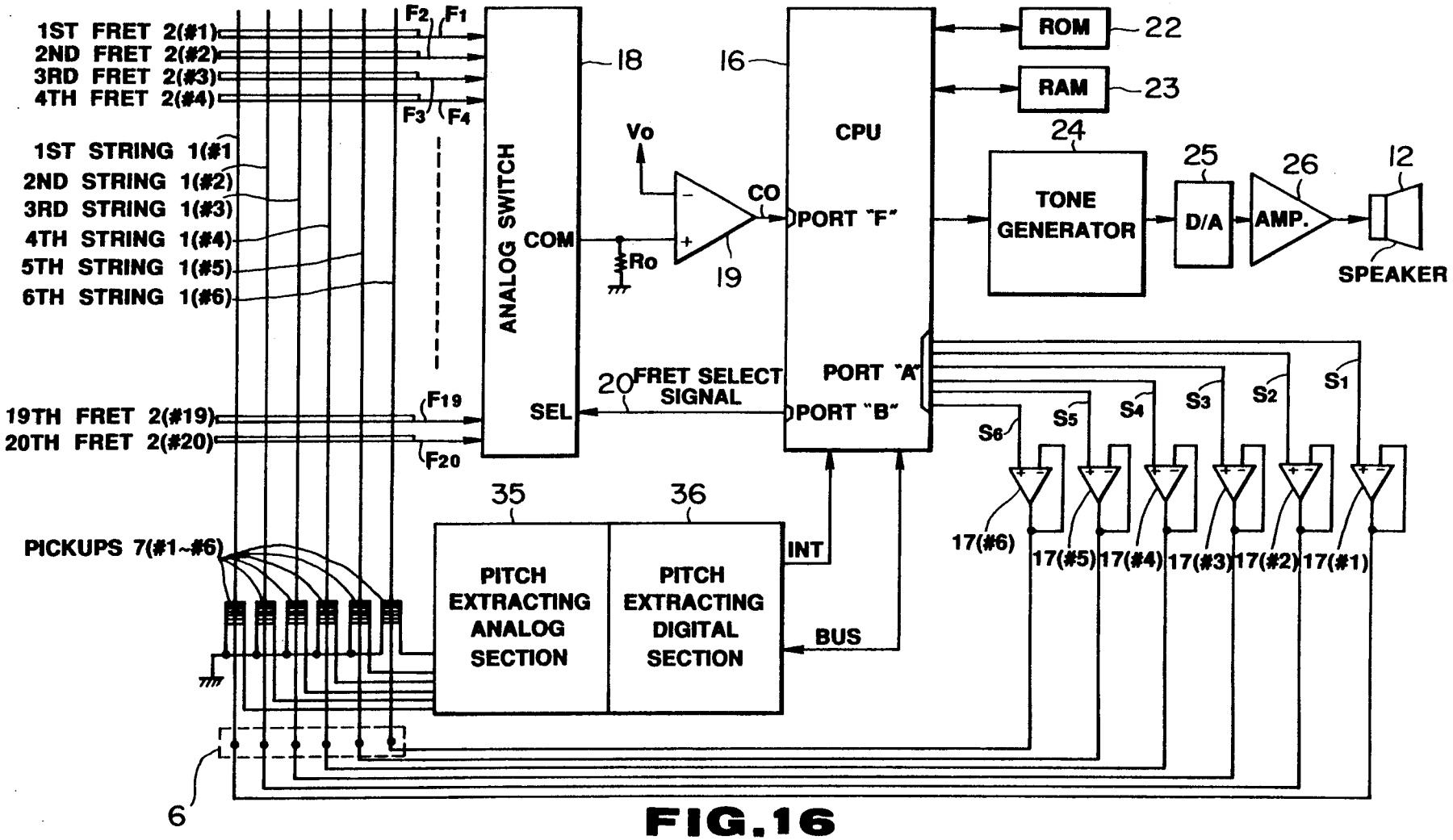
FIG. 16 is a block diagram illustrating the third embodiment.

In the same interval T10, on the other hand, string signal MS2 from the second string also becomes, as in the previous case, a potential obtained by high level potential VH and ground potential (0 volts) with resistances 33 and 34 and pulldown resistance Ro, i.e., MS1=VH(Ro/2)/(Ro+Ro/2)=VH/3. Hence, string detect output S2' from comparator 28 (#2) also becomes high level potential VH as shown in FIG. 15. As a result, CPU 16' can recognize hat the second string is also in contact with the (n+1) fret as indicated in FIG. 16.

Finally, FIG. 14C shows the equivalent circuit for interval T11 of FIG. 15 in which voltage pulse Fn is applied to the n-th fret. This is completely opposite to the case of FIG. 14A. Hence, string signal MS1 from the first string is ground potential (0 volts) and string signal MS2 from the second string is VH/3. Consequently string detect outputs S1' and S2' of comparators 28 (#1 and #2) are at low level potential (0 volts) and high level potential VH, respectively. Then CPU 16' recognizes that the first string is not in contact with the n-th fret and the second string is in contact with the n-th fret.

Here a description will given of how to set the threshold voltage Vo' of comparators 28 (#1-#6) of FIG. 11.

In the first embodiment described above, the voltage pulses are supplied from the strings to the frets. Hence, the threshold voltage Vo of comparator 19 of FIG. 3 is determined, as described with FIG. 7, taking the case where six strings simultaneously contact a certain fret 2 into account.

On the other hand, since, in the second embodiment, the voltage pulses are supplied from the frets to the strings, each of strings 1 of FIG. 7 has only to be replaced with a fret.

By the way, the number of frets 2 that can contact a certain string 1 simultaneously is two at most during usual performance. As in the case of FIG. 7, therefore, the number of parallel resistances Ro is three at most, even inclusive of the pulldown resistance.

Hence, as in the case of FIG. 7, the threshold voltage Vo may be set such that VH>Vo'>0.

As shown in FIGS. 13 to 15, the second embodiment of FIG. 11 can operate in exactly the same manner as the first embodiment of FIG. 3 with respect to the string stopping example of FIG. 31. In the embodiment of FIG. 11, since comparators 28 are provided in parallel, the processing speed in CPU 16' can be improved.

Arrangements of Third and Fourth Embodiments

Figure 17:
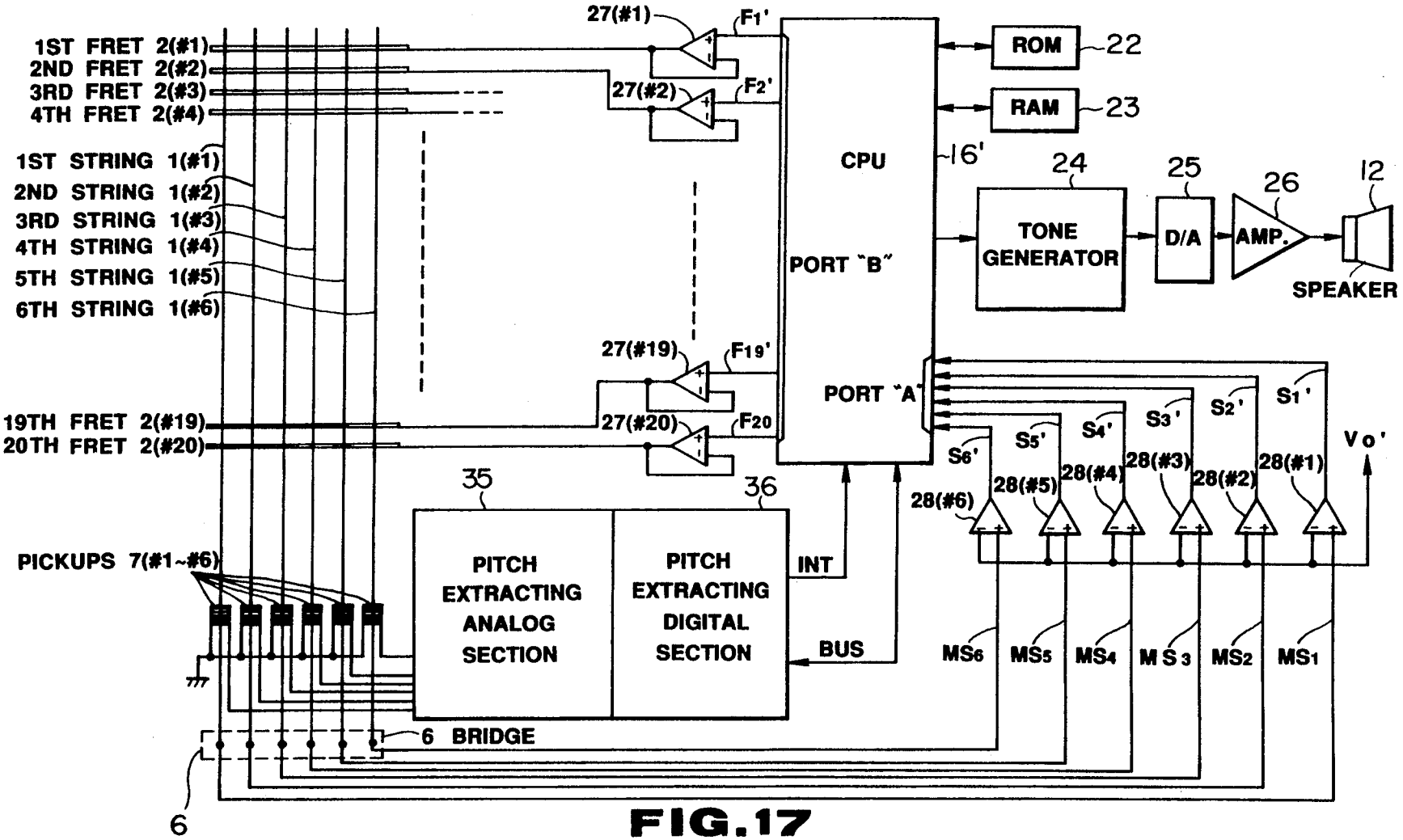
FIG. 17 is a block diagram illustrating the fourth embodiment.

In FIGS. 16 and 17, there are illustrated third and fourth embodiments of the invention, which correspond to the first embodiment (FIG. 3) and the second embodiment (FIG. 11), respectively.

In these embodiments, pitch bend detectors 502 and 503 are excluded from the exterior arrangement of the instrument shown in FIGS. 1A and 1B, and pickups 7 #1-#6) can directly detect vibrations of corresponding strings 1 as usual electric guitars and guitar synthesizers. Since, in those embodiments, the pitch changing process after initiation of tone generation is performed on the basis of extraction of the pitch from vibration of a string, the strings used are the same as those used with usual electric guitars and guitar synthesizers in material and thickness. In addition, each string is stretched at proper tension.

In FIGS. 16 and 17, a pitch extracting analog section 35 is a circuit for producing various digital signals (to be described later) from waveform signals corresponding to strings 1 (#1-#6) which are output from pickups 7 (#1-#6).

A pitch extracting digital section 36 produces various parameters (to be described later), such as peak values for pitch extraction and zero-crossing times, on the basis of various signals from pitch extracting analog section 35 and provides these parameters to CPU 16 or 16' via a bus BUS by interrupting CPU 16 or 16' using an interruption signal INT.

On the other hand, CPU 16 or 16' of FIG. 16 or 17 is responsive to various information signals from pitch extracting digital section 36 to detect which of strings 1 (#1-#6) has been picked, to detect a fret number for the picked string, that is, which of frets 2 (#1-#20) is in contact with the picked string in accordance with the operations described in the first and second embodiments through comparator 19 or comparators 28, and provides to tone generator 24 information for initiating generation of a tone at a pitch corresponding to the fret number.

The above control operation is performed on the basis of a control program stored in a ROM 22 connected to CPU 16 or 16'.

Operation of Third and Fourth Embodiments

Figure 18:
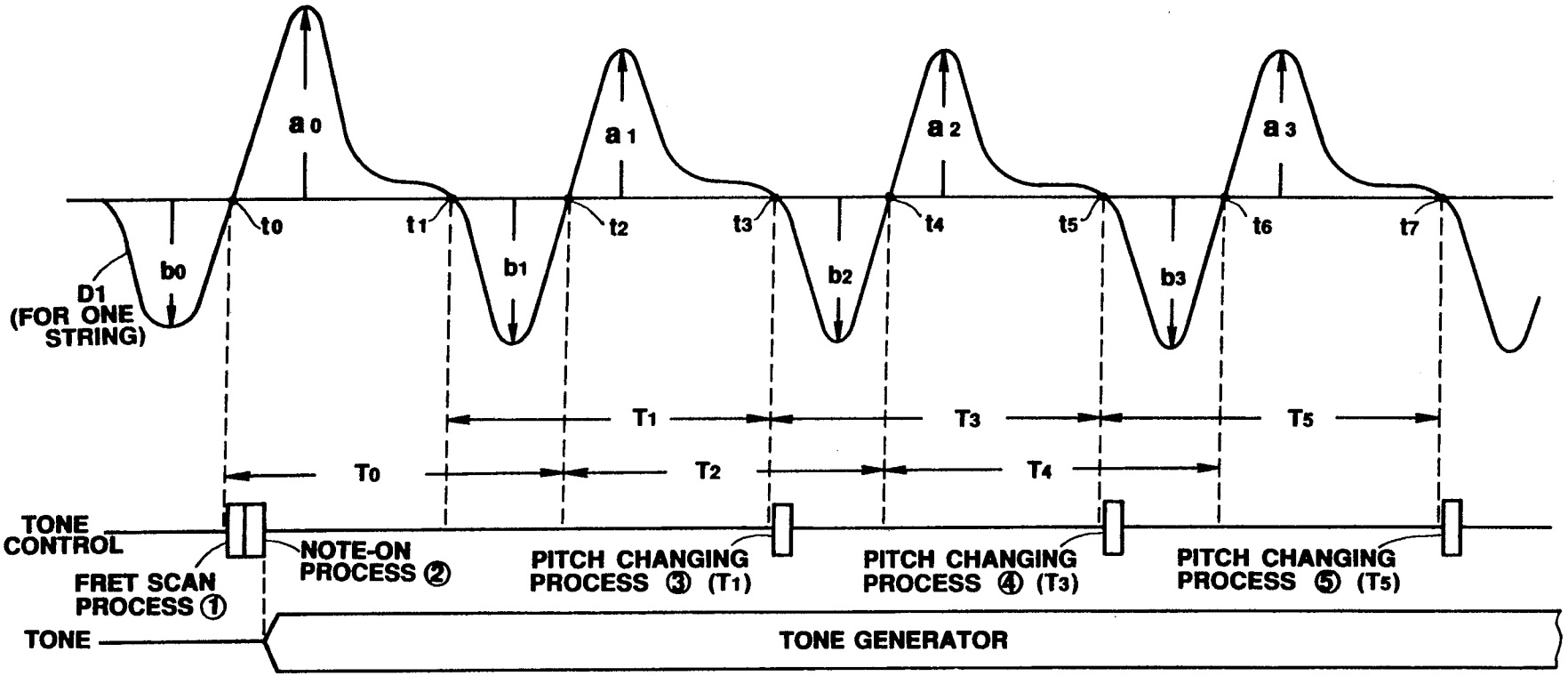
FIG. 18 is a diagram for explaining the operations of the third and fourth embodiments.

FIG. 18 shows a digital waveform signal DI output from pitch extracting analog section 35 to pitch extracting digital section 36 for one string in an analog manner. This waveform is obtained by filtering an electrical signal detected from a corresponding pickup 7 when a string 1 is picked by a lowpass filter and then A/D converting it. By picking the string while stopping it in a place between frets 2 on fingerboard 4 of FIGS. 1A and 1B, the oscillating waveform is produced which has pitch periods T0-T5 shown in FIG. 18.

Next, pitch extracting digital section 36 in the third and fourth embodiments extracts peak values a0-a3 or b0-b3 and zero crossing times t0-t7 immediately after the peak values and interrupts CPU 16 or 16' by issuing interruption signal INT thereto so as to transfer those pieces of data in sequence to the CPU.

At a point of time when the first set of data (b0, t0) is entered, CPU 16 or 16' decides that a string has been picked and detects a fret number for the picked string instantly as described in the first and second embodiments, that is, which of frets 2 (#1-#20) has contacted the picked string. This operation is called a fret scan process hereinafter and its timing is shown at ① in FIG. 18.

After the fret number is detected, the CPU prepares pitch information corresponding to the fret number and performs a note on process (② in FIG. 18) to supply the pitch information to tone generator 24 together with key-on (tone initiating) information.

Tone generator 24 thus initiates generation of a tone signal at a specified pitch. The tone signal is converted to an analog signal by D/A converter 25 and then sounded by speaker 12 after amplification by amplifier 26.

Subsequently the CPU extracts pitch periods T0-T6 shown in FIG. 18 from sets of data (a0, t1), (b1, t2), (a1, t3) and so on in real time, which are sequentially entered into the CPU every time it is interrupted by interruption signal INT from pitch extracting digital section 36. And the CPU produces pieces of pitch information in sequence on the basis of pitch periods T1, T3, T5 and so on which are newly obtained at ③, ④, ⑤ and so on of FIG. 18 and supplies them to tone generator 24, thereby performing the pitch varying process in which the pitch of a tone being sounded is subjected to a sequence of variations on the basis of the pitch information.

Therefore, in such a case where a player performs a pitch bend operation to vary the tension of a picked string after initiation of tone generation, the pitch periods T0-T5 and so on of the digital waveform signal DI of FIG. 18 vary correspondingly. This will add much to expression of musical sounds.

On the other hand, in an attempt to obtain pitch information only from digital waveform signal DI of FIG. 18 so as to start sounding of a tone, a wait time of at least about 1.5 pitch periods will be needed until pitch information of T0, T1 and so on near the time of rise of the waveform is obtained. For this reason, picking of a string of a low tone in particular, which is long in pitch period, will cause a marked delay in the initiation of sounding the tone, thus making the response of the musical instrument poor.

According to the present embodiment, by paying an attention to the fact that the fundamental pitch period of vibration of a string is defined by the position of a fret where the string is stopped, an electronic stringed instrument is realized which prepares only the pitch information needed at a time of initiation of tone generation from the fret number obtained by the fret scan process of ① in FIG. 18 and can therefore perform the note-on process for initiating tone generation very fast.

The tension of each string can previously be tuned up by a peg so as to correspond to pitch information specified by the position of each fret.

It is to be noted that, in the above operation, outputs of pickups for six strings are naturally processed on a time division basis.

As can be seen from the foregoing, the electronic stringed instruments according to the third and fourth embodiments combine a system for extracting pitch information from vibrations of strings to control tone generation and a fret-number detecting system based on the first and second embodiments for making the response at a time of initiation of tone generation fast. In this case, since such a fret structure as shown in FIGS. 2A and 2B is adopted, the neck portion scarcely needs processing as compared with usual acoustic guitars. This is excellent as compared with the fourth or fifth prior art described in the "BACKGROUND OF THE INVENTION" in which the neck portion has to be much processed. If the neck portion is much processed, the vibrations of strings would be seriously affected. Particularly with an electronic stringed instrument in which string vibration is detected to control tone generation, deterioration in tone quality would be inevitable. With the third and fourth embodiments, however, the deterioration in tone quality can be suppressed to a minimum, and moreover an electronic stringed instrument with a good response can be provided.

Body 9 of the instrument shown in FIGS. 1A and 1B may be provided with a tremolo arm which can change the tension of all the strings at a time so as to change the pitch periods of vibrations of strings 1 (#1-#6). This will provide the same effect as the pitch bend operation.

A problem of malfunction resulting from the strings coming close to each other or contacting each other during a pitch bend operation will scarcely arise because, as described in connection with the first embodiment, the detection of a fret number is performed only in the fret scan process ① (refer to FIG. 18) at a time of initiation of tone generation at which there is little possibility of the pitch bend operation.

In the above description, the extracting operation for pitch periods has not been detailed because the present invention is directed particularly to the fret structure and the fret-number detection. The extracting operation is disclosed in detail in a prior application Ser. No.

252,914 (Shigeru Uchiyama) filed Oct. 3, 1988 by the same applicant as this application.

The Arrangement of Fifth Embodiment

The fifth embodiment and the first embodiment of FIGS. 1A and 1B are the same in their exterior structure and in the structure of pitch bend detectors 502 and 503 illustrated in FIG. 1C as well, but different in the structures of neck 3 and strings 1.

Figure 19A:
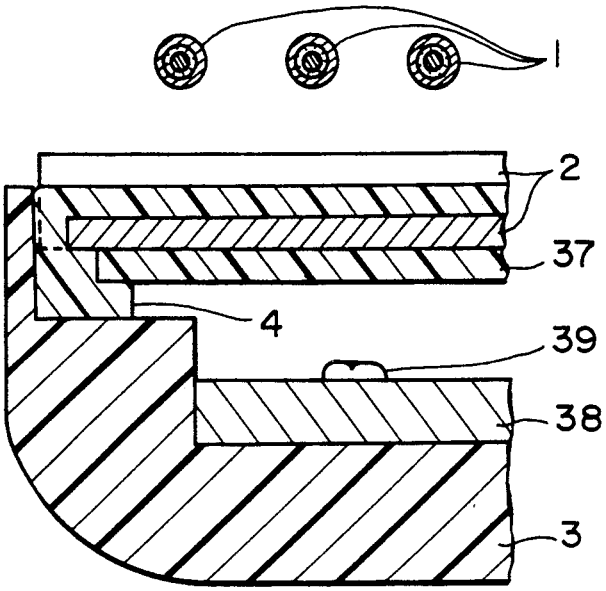
FIGS. 19A to 19C are diagrams illustrating the structure of a neck portion according to the fifth embodiment.
Figure 19B:
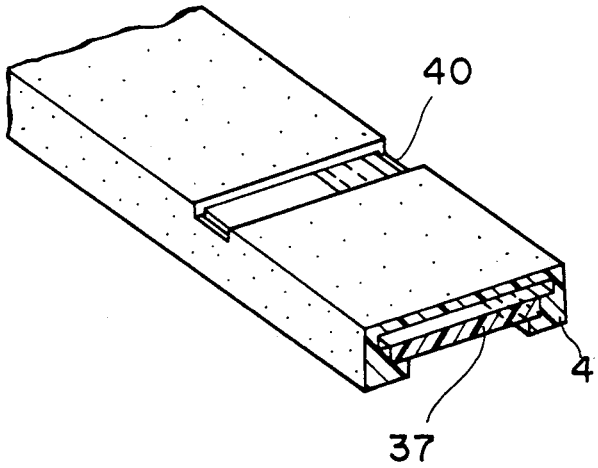
Figure 19C:
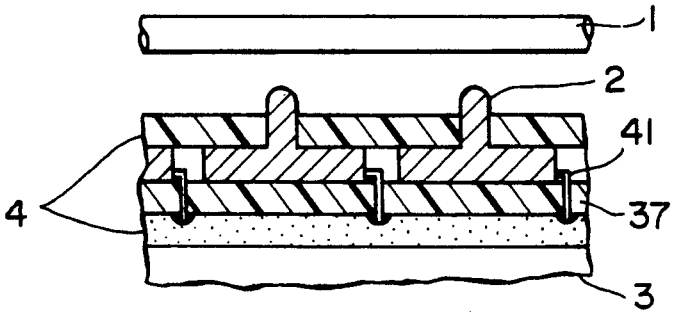

FIGS. 19A to 19C illustrate a detailed structure of a portion of neck 3 of FIGS. 1A and 1B. More specifically, FIG. 19A is a sectional view taken along line 2—2 of FIG. 1A, FIG. 19B is a perspective view of the fingerboard with a conductive fret member excluded, and FIG. 19C is a sectional view taken along line 1—1 of FIG. 1A.

A groove is formed in the central part of plastic neck material 3 (the same as neck 3 of FIG. 1A) along its lengthwise dimension, and a neck reinforcing member 38 is fixed therein by a locking screw 39.

Fret mounting slots 40 are formed in parts of plastic fingerboard 4 (refer to FIG. 1A or 1B) fit into a groove above the groove as shown in FIG. 19B, and conductive fret members 2 (made of metal or carbon) are inserted into slots 40 from the underside thereof.

Moreover, a printed-wiring board 37 is disposed along the lengthwise dimension of neck member 3 (in the direction in which the strings are stretched) so as to sandwich fret members 2 with fingerboard 4. Connected to each of conductive fret members 2 is a lead 41 which is in turn connected to a wiring pattern on printed wiring board 37 for electrical connection to circuitry described later installed within body 9 of FIGS. 1A to 1C.

Figure 20:
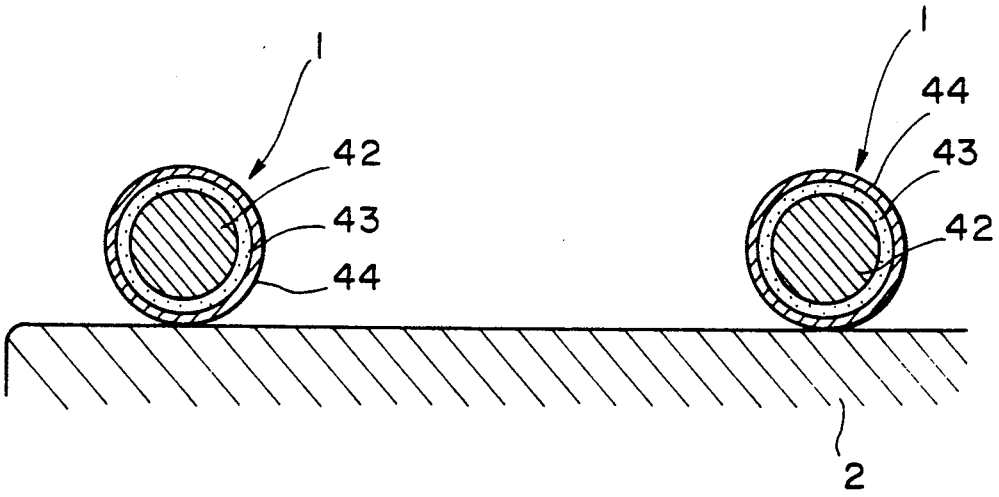
FIG. 20 is a detailed diagram illustrating the structure of strings for use in the fifth embodiment.

In FIG. 20, there is shown a detailed structure of each of strings 1 (six in all) of FIG. 1A, 1B or 19. As shown, the string comprises a conductive string member 42 which is the main component member of the sting, a resistance film member 43 formed on the periphery of member 42 and a conductive reinforcing film member 44 formed on the periphery of film member 43. This structure of string 1 constitutes a distinctive feature of the present embodiment.

String 1 has reinforcing film member 44 allowed to come into contact with conductive fret member 2. On contact, conductive string member 42 is electrically connected to conductive fret member 2 via resistance film member 43.

Next, the arrangement of pitch bend detector 502 or 503 is the same as that of the first embodiment shown in FIG. 1C.

In addition, the block diagram of the electronic stringed instrument according to the fifth embodiment constructed on the basis of the arrangements of FIGS. 1A to 1C and FIGS. 19 and 20 is exactly the same as the block diagram of the first embodiment shown in FIG. 3.

In FIG. 3, outputs of string drivers 17 are respectively connected to conductive string members 42 of strings 1 on bridge 6 (refer to FIGS. 1A to 1C) so that voltage pulses S1 to S6 may be respectively applied to strings 1.

On the other hand, fret signals F1 to F20 output from 21 frets (#1–#21) are output from leads 41 to printed-wiring board 37 (omitted in FIG. 3; refer to FIG. 19C).

In FIG. 3, other arrangements than the above arrangements are the same with the first embodiment.

The Operation of Fifth Embodiment

First, the timing steps of voltage pulses S1–S6 output from port 'A' of CPU 16 are the same with FIG. 4 of the first embodiment.

Suppose now that the first and second strings are stopped to come into contact with the n-th fret, and analog switch 18 (FIG. 3) selects fret signal Fn from the n-th fret in FIGS. 5A to 5C.

Figure 21A:
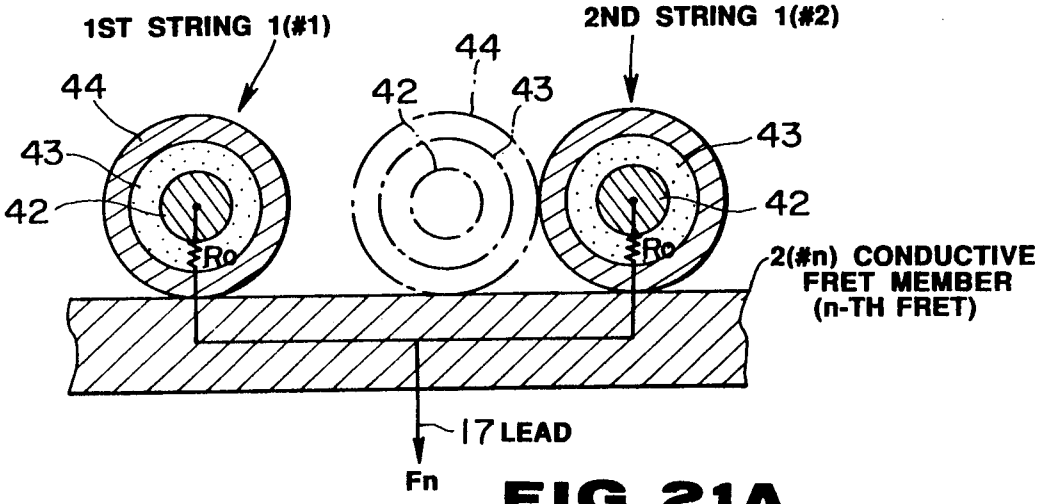
FIGS. 21A to 21C shows diagrams illustrating an equivalent circuit of the fifth embodiment in the case where the first and second strings contact each other at the n-th fret.
Figure 21C:
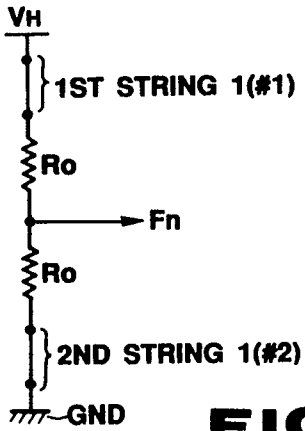
Figure 21B:
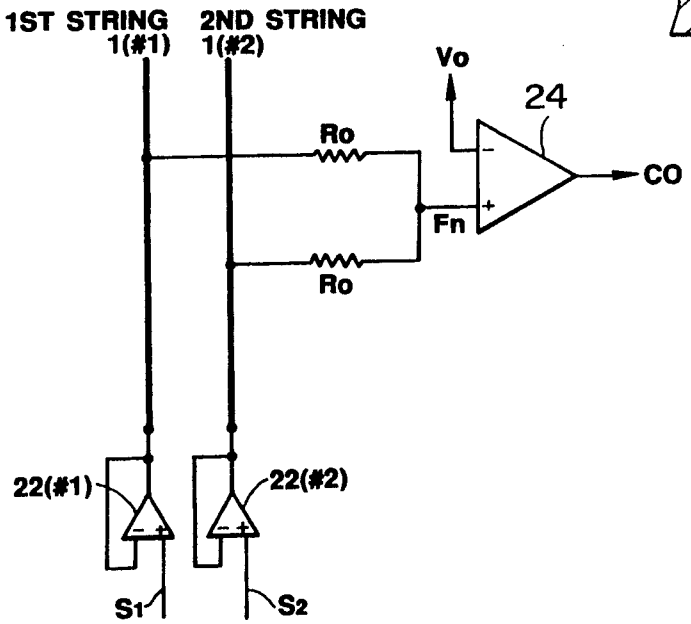

In this case, the equivalent circuit associated with the n-th fret will be as shown in FIGS. 21A to 21C. That is, between conductive string member 42 of each string (#1, #2) and conductive fret member 2 (#n) is a resistance R0 corresponding to resistive film member 43.

And the equivalent circuit of the overall system in this case is the same as the circuit of FIG. 5A of the first embodiment except for resistance Rx.

Hence, the equivalent circuit when voltage pulse S1 goes to high level potential VH in an interval in which analog switch 18 (FIG. 3) selects fret signal Fn from the n-th fret in FIGS. 5A to 5C is exactly the same as that of FIG. 5C in the first embodiment.

As a result, when voltage pulse S1 goes to high level potential VH in the interval when analog switch 18 selects fret signal Fn from the n-th fret, the operation shown in FIG. 6 of the first embodiment results. CPU 16 recognizes that fret detect output CO has gone to high level potential VH and further recognizes a string stopping state in which the first and second strings are in contact with the n-th fret.

Next, when voltage pulse S2 goes to high level potential VH in the interval in which analog switch 18 selects fret signal Fn from the n-th fret with the first and second strings contacting the n-th fret as above, the first and second strings have only to be replaced with each other in the resultant equivalent circuit of FIG. 5C as is the case with first embodiment. Hence, fret signal Fn becomes VH/3 and fret detect signal CO goes to high level potential VH in corresponding interval T2 of FIG. 6 as well. Consequently CPU 16 can recognize the string stopping state in which the second string is in contact with the n-th fret.

The threshold voltage Vo of comparator 19 of FIG. 3 may be set, in exactly the same manner as in the first embodiment, such that $VH > Vo > 0$ as can be seen from FIG. 7.

Next, the equivalent circuit of FIG. 3 when analog switch 18 selects fret signal Fn+2, Fn+1 or Fn in the case where the first and second strings are stopped as indicated at p and q in FIG. 31 is the same as that of FIG. 8 except for resistance Rx.

Hence, equivalent circuits for intervals T3, T4, T5, T6, T7 and T8 are exactly the same as those of FIGS. 9A to 9E in the first embodiment. As is the case with the first embodiment, therefore, CPU 16 can detect through comparator 19 of FIG. 3 that the first string is in contact with the (n+1)-th and (N+2)-th frets and the second string with the n-th and (n+1)-th frets.

As described above, the CPU can detect correct stopping positions in the case of FIG. 31 as well in exactly the same manner as in the first embodiment.

When the player performs a pitch bend operation during the string stopping state of FIG. 16, the amount of shift of a string is detected by pitch bend detectors 502 and 503 of FIGS. 1A and 1B and pitch bend detecting circuits 505 and 507 of FIG. 3 and entered into CPU 16 via A/D converters 506 and 508. CPU 16 then prepares pitch changing information to change the pitch of a tone being sounded in tone generator 24.

Suppose now that the first and second strings contact each other. This is the case where reinforcing film members 44 of the first and second strings contact each other. In the state of FIG. 31, reinforcing film members 44 of the first and second strings are in contact with each other indirectly via the (n+1)-th fret. The equivalent circuit in the present case is therefore exactly the same as that shown in FIG. 8 or FIGS. 9A to 9E. That is, a part of the equivalent circuit of FIG. 8 or FIGS. 9A to 9E that is associated with the (n+1)-th fret shows the equivalent circuit when reinforcing film members 44 contact each other. Hence, CPU 16 can also detect correct positions in which the strings are stopped in this case as described in connection with the case of FIG. 10.

As described in connection with the first embodiment, if the fret detection is performed only at a time of initiation of picking of a string, no problems arise because a pitch bend operation is seldom performed simultaneously with a string stopping operation. With the fifth embodiment, a malfunction never occurs even if the strings come close to each other or contact each other, thus permitting highly reliable fret detection.

The Arrangement of Sixth Embodiment

A sixth embodiment of the electronic stringed instrument constructed on the basis of the arrangements shown in FIGS. 1A to 1C, FIGS. 19A to 19C and FIG. 20 may be identical in block form to the second embodiment of FIG. 11. Namely, the sixth embodiment is identical to the fifth embodiment in the structures of neck 3 and strings 1 shown in FIGS. 19A to 19C and 20 but different from system configuration of FIG. 3 in that the voltage pulses are applied to frets 2 and they are detected from the strings on bridge 6.

In this case, string signals MS1 to MS6 to be applied to the noninverting inputs of comparators 28 (#1–#6) are obtained from corresponding conductive string members 42 (refer to FIG. 20) of strings 1 on bridge 6 (refer to FIG. 1A).

The other arrangements of FIG. 11 are the same with the second embodiment.

The Operation of Sixth Embodiment

The timing diagram of voltage pulses F1′ to F20′ output from port 'B' of CPU 16′ is the same as that of FIG. 12 according to the second embodiment.

Where the first and second strings are stopped as indicated at p and q in FIG. 31, the equivalent circuit of the system of FIG. 11 in an interval in which voltage pulse Fn+2′, Fn+1′ or Fn′ is raised to high level voltage VH in FIG. 12 is the same as that of FIG. 13 according to the second embodiment except for resistance Rx.

Hence, the equivalent circuits in the case of intervals T9, T10 and T11 are identical to those of FIGS. 14A to 14C according to the second embodiment.

As a result, CPU 16′ can correctly detect such a string stopping state as shown in FIG. 31 as is the case with the second embodiment.

Suppose now that the first and second strings contact each other when the player performs a pitch bend operation with the strings stopped as indicated in FIG. 16. As described above, in this state, reinforcing film members 44 of the first and second strings contact each other indirectly via the (n+1)-th fret. The equivalent circuit in this case is exactly the same as that of FIG. 13, or one of FIGS. 14A to 14C. That is, the equivalent circuit associated with the (n+1)-th fret in FIG. 13 or one of FIGS. 14A to 14C corresponds to the equivalent circuit when reinforcing film members 44 contact each other. Hence, in this case as well, CPU 16′ can correctly detect positions in which strings are stopped as is the Case with FIG. 15.

The above fifth and sixth embodiments are adapted for use with such a string with three layers as shown in FIG. 20. However, the structure of the string is not limited to the three-layer structure of FIG. 20. If there is no problem of strength, a two-layer structure without the outermost reinforcing film member 44 may be used. In other words, it is only required that a string and a fret be electrically connected together via resistance when they contact each other.

The Arrangements and Operations of Seventh and Eighth Embodiments

The system configurations of seventh and eighth embodiments are the same as those of the third and fourth embodiments shown in FIGS. 16 and 17 and correspond to FIGS. 3 and 11, respectively.

In this case, the structures of neck 3 and strings 1 of FIGS. 19A to 19C and 20 are exactly the same as those of the fifth and sixth embodiments. As described in connection with the fifth and sixth embodiments, however, pitch bend detectors 502 and 503 are excluded and pickups 7 can detect vibrations of strings directly as is the case with usual electric guitars. And, the arrangements of FIGS. 16 and 17 are exactly the same with the third and fourth embodiments.

The electronic stringed instruments according to the seventh and eighth embodiments combine the pitch extracting system for extracting the pitch from vibration of a string to control tone generation and the fret-number detecting system, based on the fifth and sixth embodiments, to speed up the response at a time of initiation of tone generation. It is thus possible to obtain the same advantages as those of the third and fourth embodiments.

Arrangement of Ninth Embodiment

Figure 22A:
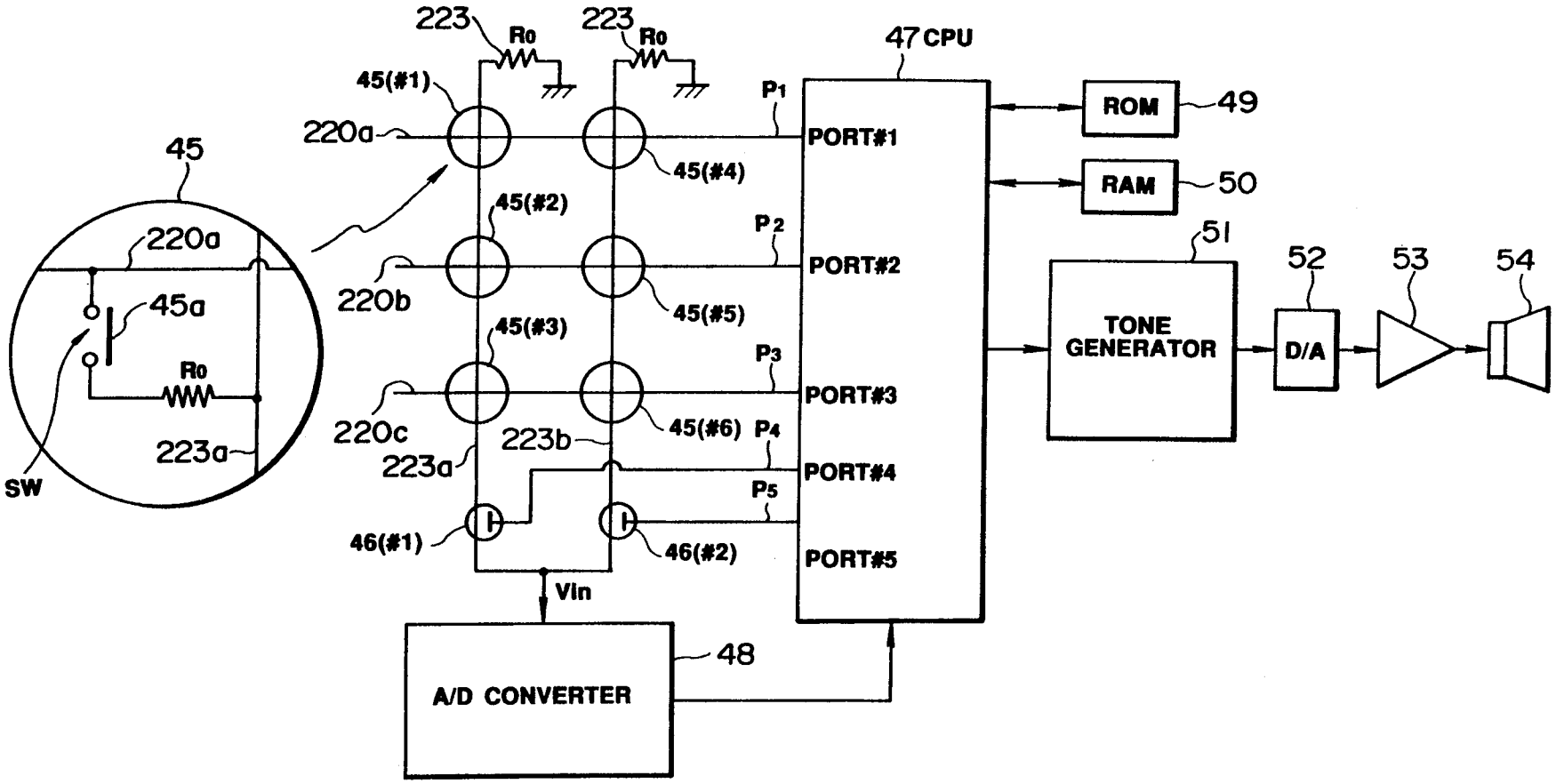
FIG. 22A is a block diagram of the ninth embodiment.
Figure 22B:
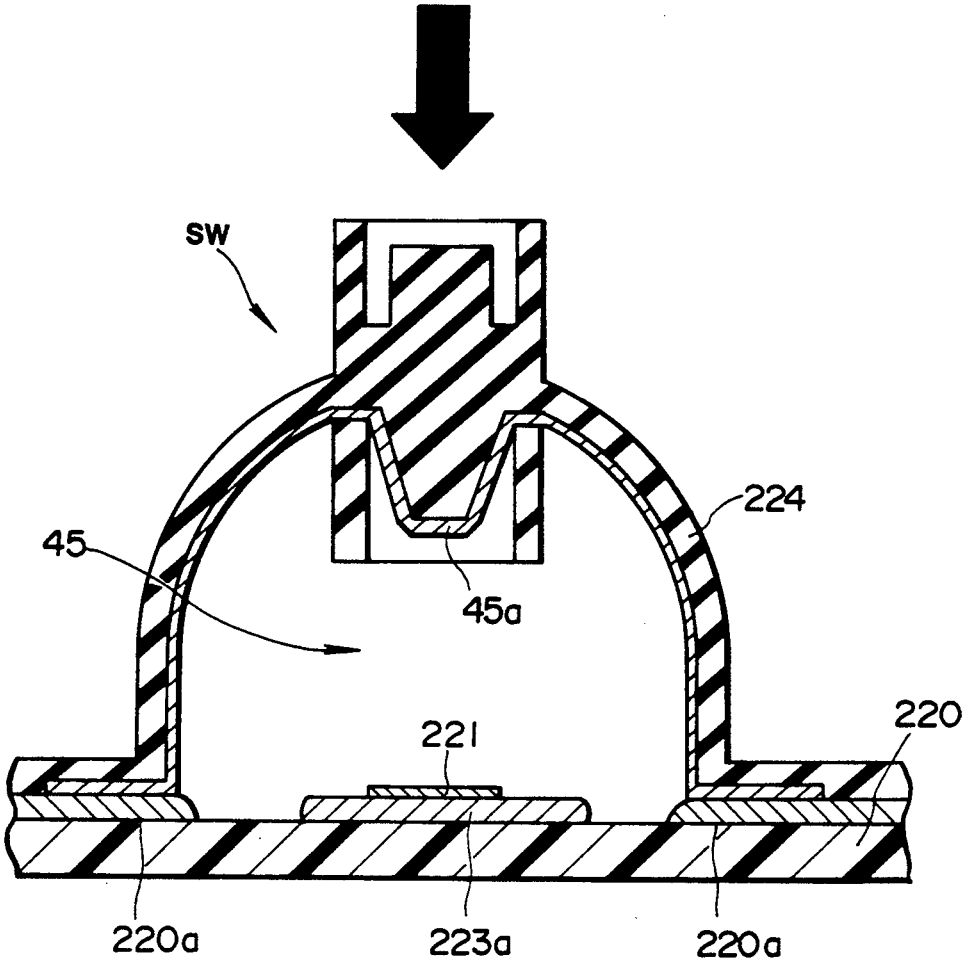
FIG. 22B is a cross-sectional view of a switch section 45.
Figure 22C:
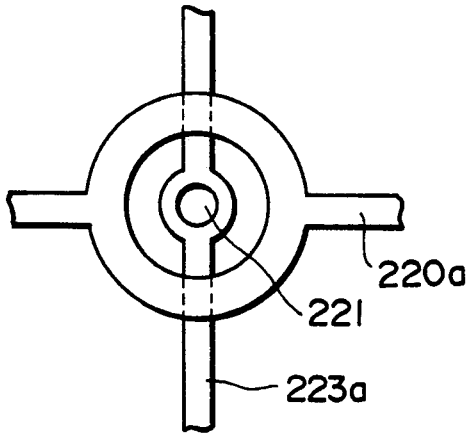
FIG. 22C is a plan view of a switch section 45.

FIGS. 22A to 22C show a block diagram of a ninth embodiment in which a switch matrix according to the present invention is used as a switch section of an electronic musical instrument. Examples of the electronic musical instrument may include an electronic keyboard, an electronic stringed instrument, an electronic wind instrument and so on. The present embodiment need not limited to electronic musical instruments and may be applied to various control devices using a switch matrix, for example, various types of electronic equipment, such as small electronic calculators.

In FIG. 22A, switch portions 45 (#1–#6) comprise various types of control switches for setting tone colors, rhythms and parameters used in the electronic musical instrument. As shown in FIGS. 22B, 22C and 22D. switch portions 45 are provided at intersections of row connection lines 220*a* to 220*c* and column connection lines 223*a* and 223*b*. Each of switch portions 45 has a domed elastic support member 224 and a conductive terminal 45*a* formed on the inner surface of the support member. A resistance layer 221 is formed on each of column connection lines 223*a* and 223*b* at the intersections. When switch portion 45 is depressed, terminal 45 is electrically connected to column connection line 23*a* or 223*b* through resistance layer 221. At each intersection the row and column connection lines are electrically insulated from each other by an insulator not shown.

Row connection line 220*a*, which is supplied with a voltage pulse P1 from a port PORT#1 of a CPU 47, is connected to terminal 45*a* of a switch element SW (refer to FIGS. 22B and 22D) of each of switch portions 45 (#1 and #4). Similarly row connection line 220*b*, which is supplied with a voltage pulse P2 from a port PORT#2 of CPU 47, is connected to terminals 45 of switch portions 45 (#2 and #5), while row connection line 220*c*, which is supplied with a voltage pulse P3 from a port PORT#3, is connected to terminals 45*a* of switch portions 45 (#3 and #6).

Terminal 45*a* of switch element SW of each of switch portions 45 is connected to resistance layer 221 of a resistance of Ro. Voltages applied to resistance layers 221 of switch portions 45 (#1–#3) are input to a gate 46 (#1) and pulled down to ground potential via a resistor 223 of a resistance of Ro. Similarly other terminals of resistance layers 221 of switch portions 45 (#4–#6) are input to gate 46 (#2) and pulled down to ground potential via a resistor 223 of a resistance of Ro. Pull-down resistors 223 are provided to keep the input of an A/D converter 48 at ground potential when none of switch portions 45 are turned on, otherwise an input voltage Vin of A/D converter 48 will become indefinite and a malfunction may occur.

Gates 46 (#1 and #2) are turned on when voltage pulses P4 and P5 from PORT #4 and #5 of CPU 47 go high, thus providing their input voltages to A/D converter 48 as output voltage Vin.

An output of A/D converter 48 is applied to CPU 47.

To CPU 47 are connected a ROM 49 which stores programs for carrying out control operations described later and a RAM 50 which serves as a work area for the programs or a storage area into which musical tone information is entered for a user.

Various types of tone control information are applied from CPU 47 to a tone generator 51, which accordingly produces tone signals. The tone signals are converted by a D/A converter 52 to analog tone signals which are amplified by an amplifier 53 and then sounded by a speaker 54.

Resistance Ro in switch portion 45 can be realized readily and inexpensively by forming a resistance thin film 221 onto a printed board 220 using a carbon process.

If, unlike the present embodiment, terminal 45*a* formed in switch element SW of switch portion 45 is a rubber contact and the rubber contact is formed by the carbon process, then the contact and a resistance thin film corresponding to resistance thin film 221 can be printed at a time, thus saving cost. If switch portion 45 is constituted by a rubber contact type switch, no resistance layer (221 in FIG. 2B) will be needed on column connection line 223*a* because the contact itself, constituted by first terminal 45*a*, is formed by the carbon process and has inherently a predetermined resistance.

The Operation of the Ninth Embodiment

Figure 23:
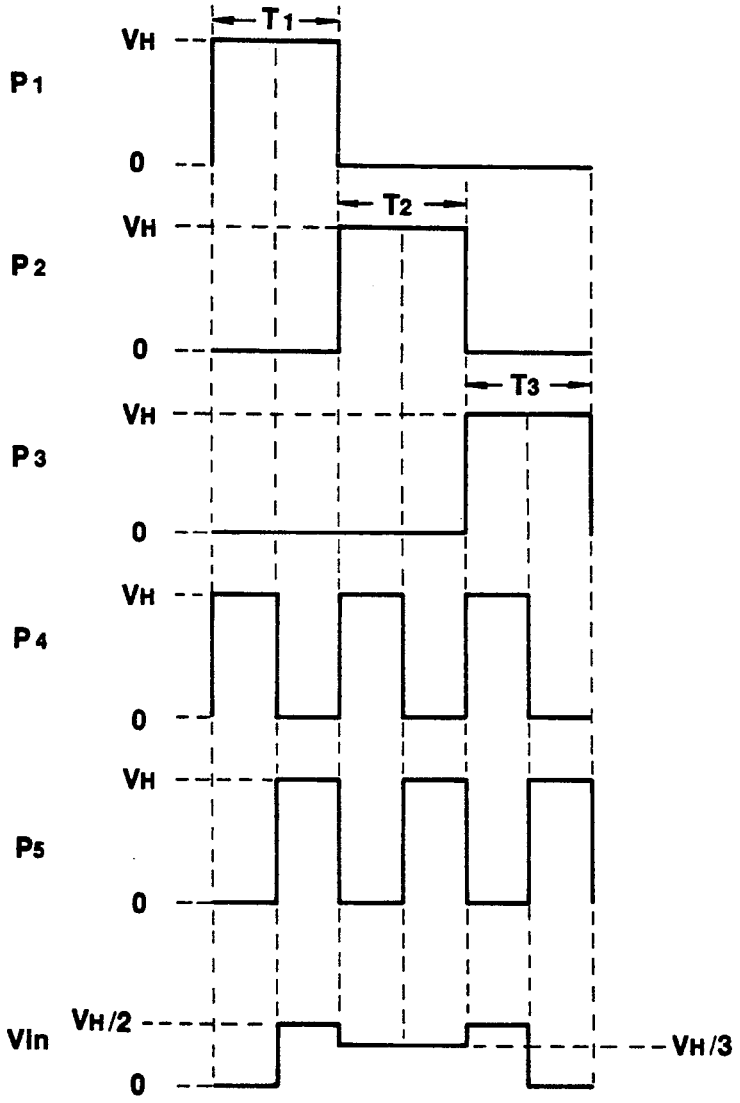
FIG. 23 is a timing chart for the operation of the ninth embodiment in the case shown in FIG. 31.

Voltage pulses P1–P3 output from PORTs #1–#3 of CPU 47 sequentially go to a high level potential VH of a logic 1 in successive intervals T1, T2 and T3 as shown in FIG. 23 in accordance with a flowchart (FIG. 24) described later. Voltage pulse P4 output from PORT #4 of CPU 47 goes to high level potential VH during the first half of each of intervals T1–T3 and goes to ground potential of 0 volts during the latter half of each interval. On the other hand, voltage pulse P5 from PORT #5 of CPU 47 goes to ground potential during the first half of each of the intervals and goes to VH during the latter half of each interval.

An operation of the circuit of FIG. 22A when switch portions 45 (#2, #3, #4 and #5) are turned on simultaneously will now be described. The switch-on state is substantially the same, in electrical state, as the string-stopped state, shown in FIG. 31, in the first through eighth embodiments of the electronic stringed instrument described above.

Figure 25C:
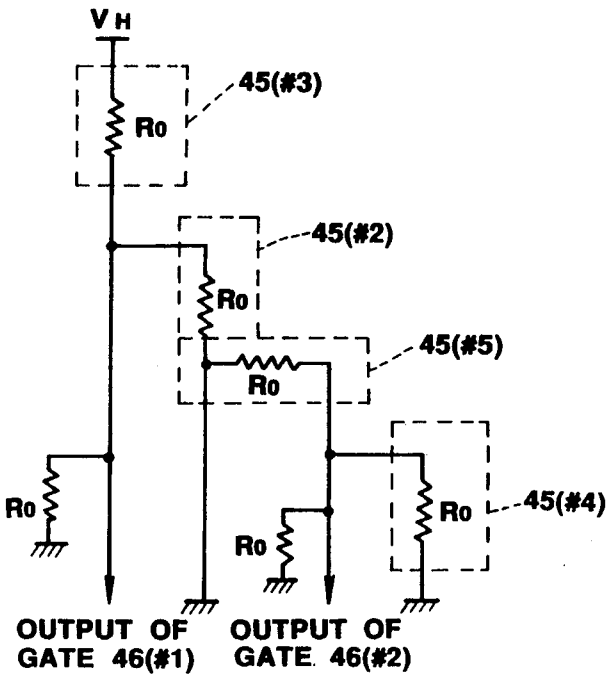
Figure 25B:
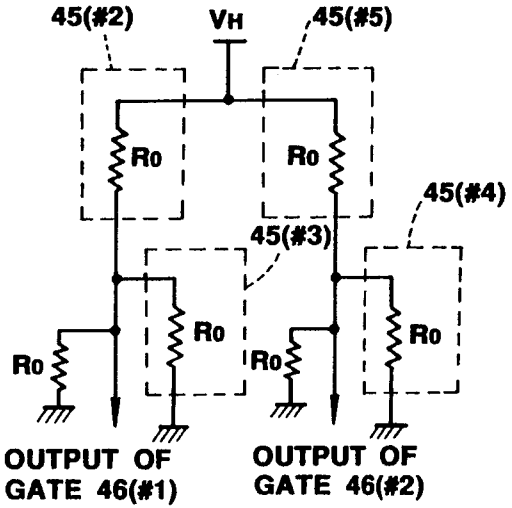
Figure 25A:
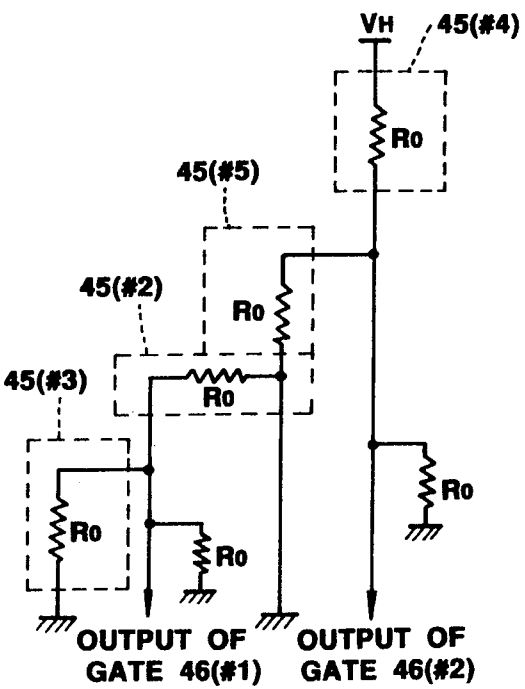

In the above case, the equivalent circuit of the system of FIG. 22A when voltage pulse P1, P2 or P3 from CPU 47 goes to VH will be shown as in FIG. 25A, FIG. 25B or FIG. 25C. The equivalent circuits of FIGS. 25A, 25B and 25C are substantially the same as the equivalent circuits shown in FIGS. 14A, 14B and 14C, respectively, of the second or sixth embodiment.

FIG. 25A illustrates the case where voltage pulse P1 of high level potential VH is applied to PORT #1 of CPU 47 of FIG. 22A during interval T1 of FIG. 23. When voltage pulse P4 applied to PORT #4 of CPU 47 goes to VH in the first half of T1, output Vin of gate 46 (#1) of FIG. 22A becomes Vin=0 as in the case of MS1 of FIG. 14C associated with the second embodiment. By recognizing the output of A/D converter 48 to be 0 volts, therefore, CPU 47 can judge that switch portion 45 (#1) is off.

On the other hand, when voltage pulse P5 applied to PORT #5 of CPU 47 goes to VH in the latter half of T1, output Vin of gate 46 (#2) becomes Vin=VH/3 as in the case of MS2 of FIG. 14C. By detecting VH/3 through A/D converter 46, therefore, CPU 47 can recognize that switch portion 45 (#4) is on.

Next, FIG. 25B illustrates the case where voltage pulse P2 of high level potential VH is applied to PORT #2 of CPU 47 during interval T2 of FIG. 23. When voltage pulse P4 applied to PORT #4 of CPU 47 goes to VH in the first half of T2, output Vin of gate 46 (#1) becomes Vin=VH/3 as in the case of MS1 of FIG. 14*b*. Therefore, CPU 47 can recognize that switch portion 45 (#4) is on.

On the other hand, when voltage pulse P5 applied to PORT #5 of CPU 47 goes to VH in the latter half of T2, the output Vin of gate 46 (#2) becomes Vin=VH/3 as in the case of MS2 of FIG. 14B. Therefore, CPU 47 can recognize that switch portion 45 (#5) is also on.

Finally, FIG. 25C illustrates the case where voltage pulse P3 of high level potential VH is applied to PORT #3 of CPU 47 during interval T3 of FIG. 23. This is the direct opposite of the case of FIG. 25A. Hence, when voltage pulse P4 applied to PORT #4 of CPU 47 goes to VH in the first half of T3, the output Vin of gate 46 (#1) becomes Vin=VH/3. CPU 47 can recognize that switch portion 45 (#3) is on. When voltage pulse P5 applied to PORT #5 of CPU 47 goes to VH in the latter half of T3, the output Vin of gate 46 (#1) becomes Vin=0. Therefore, CPU 47 can recognize that switch portion 45 (#6) is off.

The way of setting a threshold TH used in deciding the switch-on state in accordance with digital values (A/D values) output from A/D converter 48 of FIG. 22A may be considered to be the same as in the above second embodiment. Hence the case where switch portions 45 (#1–#3) connected to gate 46 (#1) of FIG. 22A or switch portions 45 (#4–#6) connected to gate 46

(#2) turn on simultaneously has only to be taken into consideration. More specifically, in the case of the same equivalent circuit as FIG. 7, the case where the number of resistances Ro to be paralleled is four, inclusive of the pulldown resistance, will be taken into consideration. Assuming now that the quantize bit number of A/D converter 48 is eight, the high level potential VH corresponds to maximum level of 255. Hence the threshold TH has to be set such that $255/4=63>TH>0$. In practice, it is desirable that TH be on the order of 32.

Figure 24:
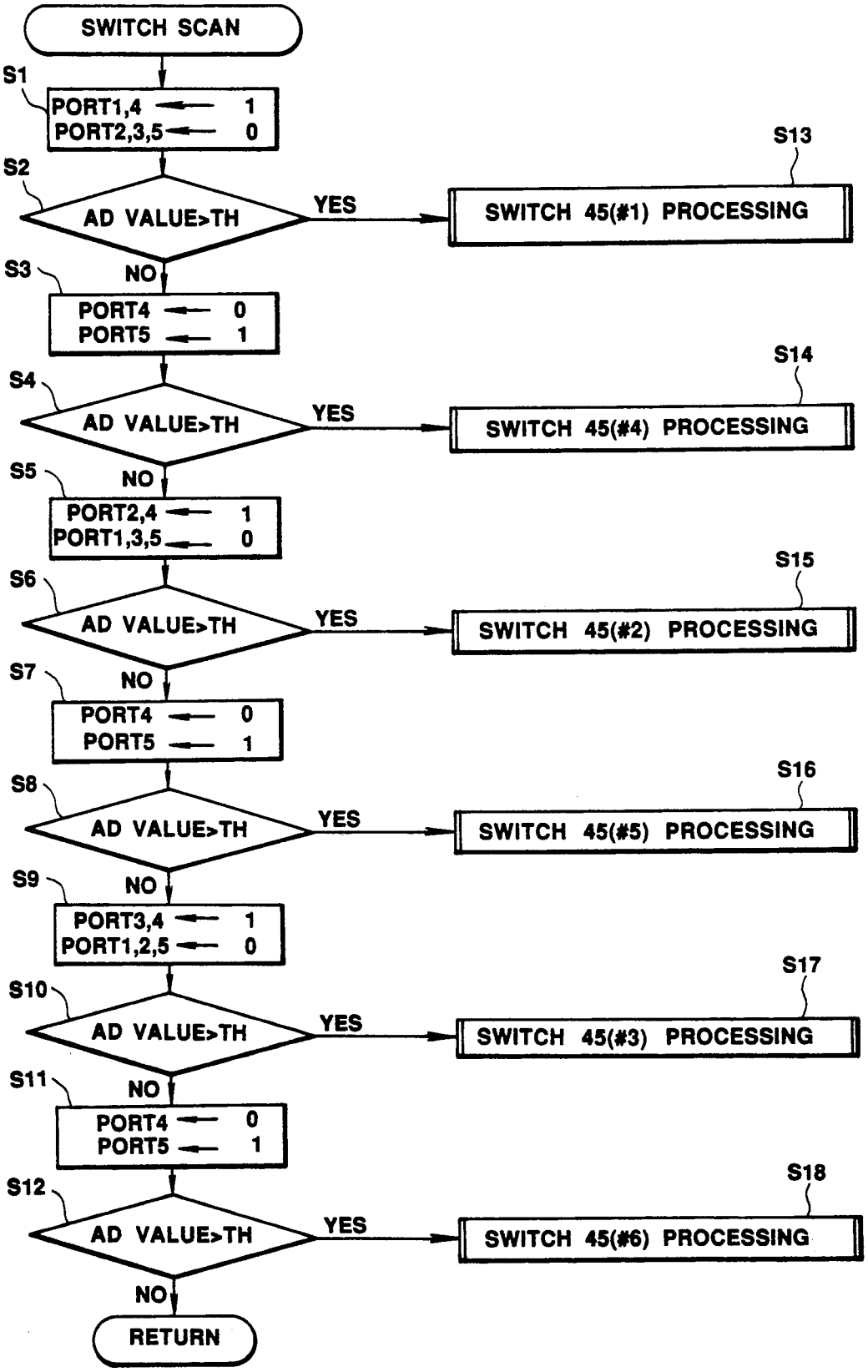
FIG. 24 is an operational flowchart for a switch scan process executed in the ninth embodiment.

In FIG. 24, there is shown a flowchart of a switch scan process carried out by CPU 47 in order to decide the switch status of each of switch portions 45 (#1–#6) during the above operation. The following steps S1–S18 will be described by referring to FIG. 24.

First, PORTs #1 and #4 of FIG. 22A are raised to a logic 1 (high level potential VH), while PORTs #2, #3 and #5 are lowered to a logic 0 (ground potential) (S1). Consequently the state in the first half of interval T1 of FIG. 23 is produced. Next, an A/D value from A/D converter 48 is read into CPU 47 so that the value is detected. As a result, if the A/D value is larger than the threshold value TH, then CPU 47 recognizes switch 45 (#1) to be turned on and carries out a subroutine for switch 45 (#1) (S2→S13). After the subroutine is performed, the step S3 is carried out. If the A/D value is not more than TH, CPU 47 determines the switch to be off and carries out the step S3 instantly.

Subsequently PORT #4 is lowered to logic 0, while PORT #5 is raised to logic 1 (S3). In this case, the states of the other PORTs remain unchanged. The state in the latter half of interval T1 of FIG. 23 is then produced. The A/D value is subsequently checked as in step S2. If the A/D value is larger than the threshold TH, then CPU 47 recognizes that switch portion 45 has (#4) been turned on and carries out a subroutine for the switch (S4→S14). After this process the step S5 is carried out. If A/D value is not more than TH, then CPU 47 decides the switch to be off and carries out step S5 instantly.

As is the case with the above, the state in the first half of interval T2 of FIG. 23 is produced in step S5 and then the subroutine for switch portion 45 (#5) is processed (S6→S15). Furthermore, the state in the latter half of interval T2 of FIG. 23 is produced in step S7 and then the subroutine for switch portion 45 (#5) is processed (S8→S16).

Similarly, the state in the first half of interval T3 of FIG. 23 is produced in step S9 and then the subroutine for switch portion 45 (#3) is processed (S10→S17). Furthermore, the state in the latter half of interval T3 of FIG. 23 is produced in step S11 and then the subroutine for switch portion 45 (#6) is processed (S12→S18).

In the ninth embodiment described above, resistance layers 221 are formed on column connection lines 223*a*, 223*b* as shown in FIG. 22B. Alternatively resistance layers 221 may be formed on terminals 45*a* connected to row connection lines 220*a*–220*c*. This will provide the same effect as the ninth embodiment.

Arrangement and Operation of Tenth Embodiment

Figure 26:
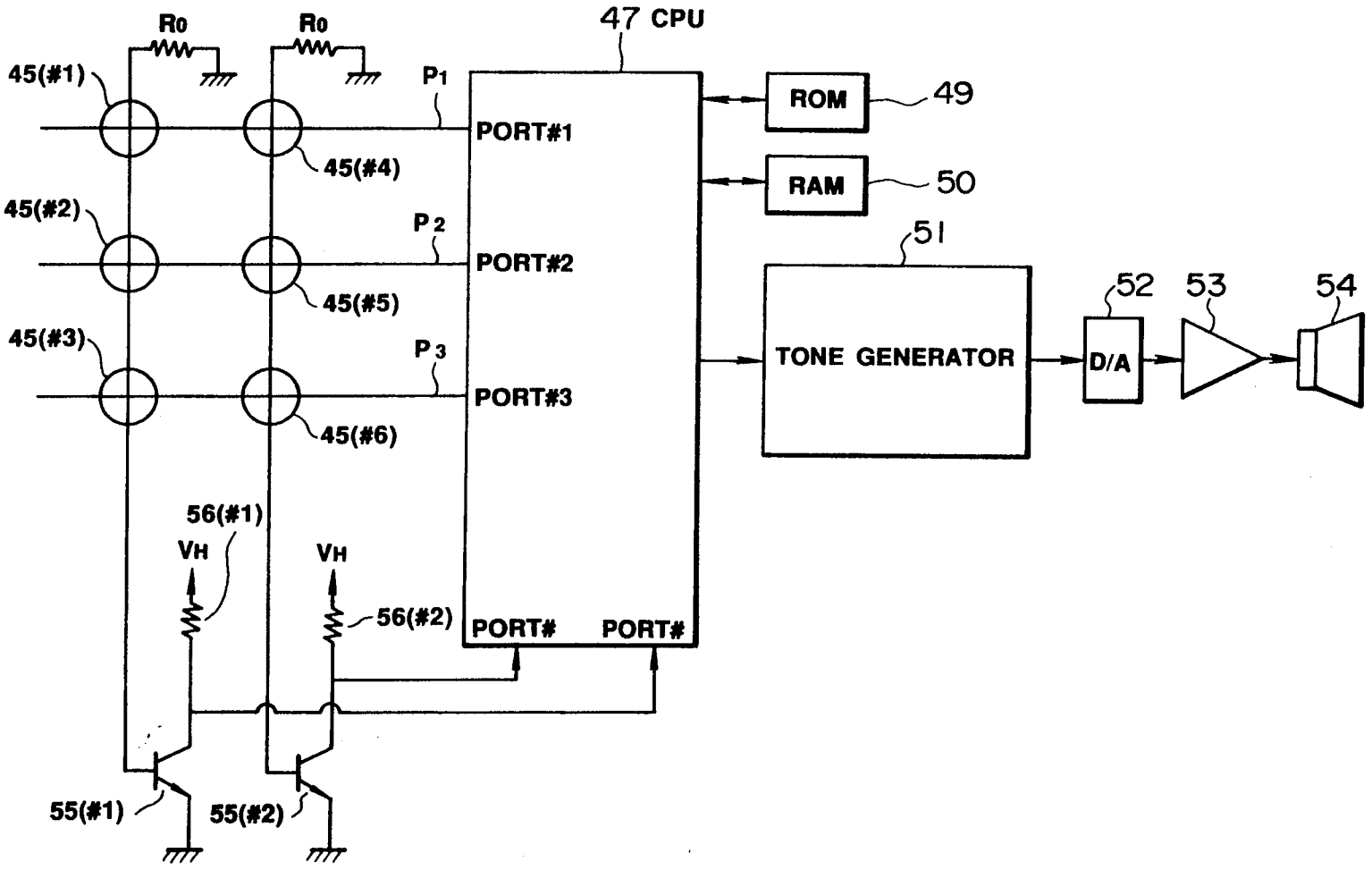
FIG. 26 is a block diagram of the tenth embodiment.

FIG. 26 is a block diagram of a tenth embodiment of the present invention. The present embodiment uses a voltage detector which combines switching transistors 55 and resistors 56 in place of a combination of gates 46 and A/D converter 48 in the ninth embodiment of FIG. 22A.

More specifically, a voltage applied to each of switch portions 45 (#1–#3) is applied to the base of transistor 55 (#1), while a voltage applied to each of switch portions 45 (#4–#6) is applied to the base of transistor 55 (#2). Transistors 55 have their emitters grounded and their collectors pulled up to a high level potential VH through resistors 56 and connected to PORTs (#4 and #5) of CPU 47.

Transistors 55 are normally off and thus PORT #4 and PORT #5 of CPU 47 are normally kept at high level potential VH.

When one of switch portions 45 is turned on and hence an input potential to the bases of transistors 55 becomes higher than about 0.5 volts, transistors 55 are turned on. Consequently PORT #4 and PORT #5 of CPU 47 are placed at ground potential.

CPU 47 can, therefore, detect the switch on through detection of ground potential at its PORT #4 and PORT #5 and perform the same processes as step S2 and the following steps in FIG. 24 on a hardware basis.

Arrangement and Operation of Eleventh Embodiment

Figure 27:
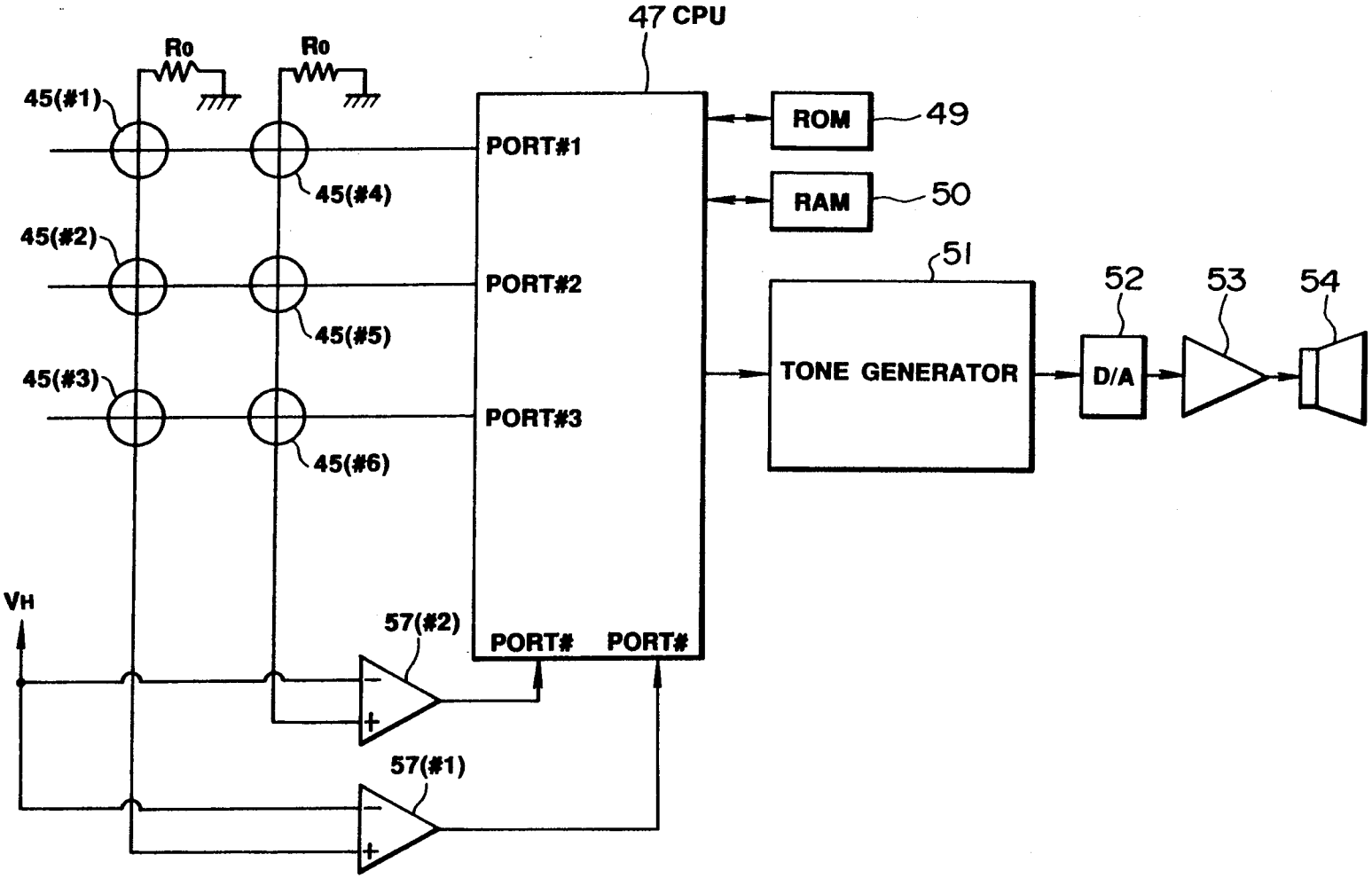
FIG. 27 is a block diagram of the eleventh embodiment.

FIG. 27 is a block diagram of an eleventh embodiment of the present invention. The present embodiment uses a voltage detector which uses comparators 57 (#1 and #2) in place of a combination of gates 46 and A/D converter 48 in the ninth embodiment of FIG. 22A. The comparators have the same function as comparators 28 used in the second embodiment of FIG. 11.

More specifically, a voltage applied to each of switch portions 45 (#1–#3) is applied to the noninverting input terminal of comparator 57 (#1), while a voltage applied to each of switch portions 45 (#4–#6) is applied to the noninverting input terminal of comparator 57 (#2). Comparators 57 are supplied at their inverting input terminals with a threshold voltage of VH/3 (corresponding to an analog version of TH described above). The outputs of comparators 57 are coupled to PORT #4 and PORT #5 of CPU 47. Though not shown, comparators 57 are supplied with high level potential VH.

Comparators 57 are normally off and hence PORT #4 and PORT #5 of CPU 47 are at ground potential.

When one of switch portions 45 is turned on and hence an input potential to comparators 57 becomes higher than VH/8, comparators 57 are turned on. Consequently PORT #4 and PORT #5 of CPU 47 are placed at high level potential VH.

CPU 47 can, therefore, detect the switch on through detection of high level potential VH at its PORT #4 and PORT #5 and perform the same processes as step S2 and the following steps in FIG. 24 on a hardware basis.

Arrangement of Twelfth Embodiment

Next, a twelfth embodiment will be described. The present embodiment is identical to the first embodiment in the exterior configuration of the electronic stringed instrument, which is shown in FIGS. 1A and 1B. And moreover the present embodiment is the same as the first embodiment in the configuration of pitch bend detectors 502 and 503 which is shown in FIG. 1C. In the present embodiment, however, frets 2 of FIGS. 1A and 1B are configured so that an equivalent circuit of a contact portion of string 1 and fret 2 may become identical to that of switch portion 45 in the ninth through eleventh embodiments described above.

Figure 28A:
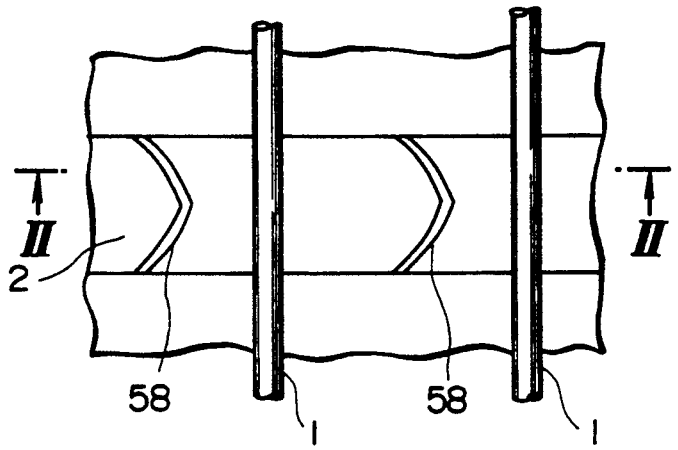
FIGS. 28A to 28C are diagrams illustrating the structure of frets used in the twelfth embodiment.
Figure 28B:
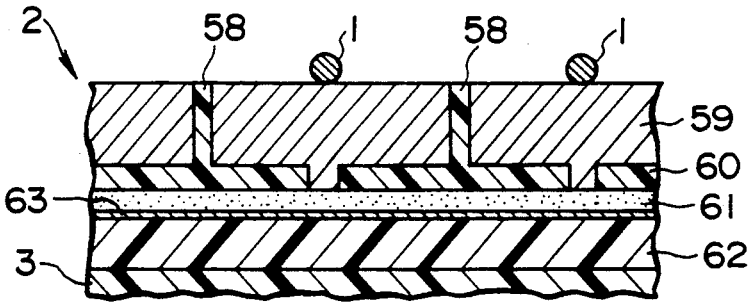
Figure 28C:
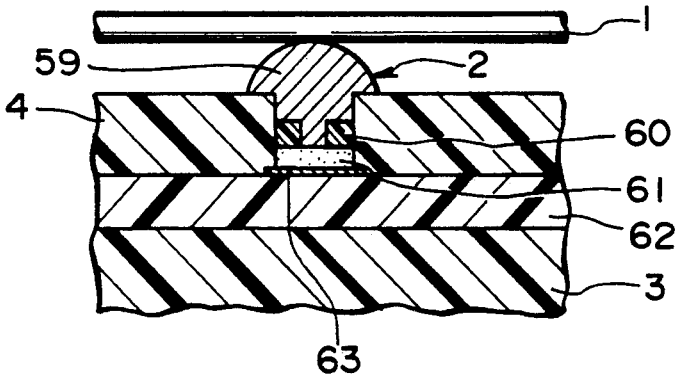

FIGS. 28A to 28C illustrate the configuration of fret 2 of FIGS. 1A and 1B in detail. FIG. 28A is a plan view of fret 2, FIG. 28B is a sectional view taken along line II—II of FIG. 1A and FIG. 28C is a sectional view taken along line I—I of FIG. 1A.

On neck 3 formed of insulating material is disposed a printed board 62, which is approximately equal to neck 3 in width, along the lengthwise dimension of neck 3 (in the direction in which strings 1 are stretched).

Each of frets 2 is embedded in a groove formed in fingerboard 3 formed of insulating material. Each of frets 2 is configured such that six conductors 59 which are under six strings 1 are electrically separated by means of six slits 58 filled with insulating material 60. Each of slits 58 is formed in the shape of the letter V as shown in FIG. 28A for ease of pitch bend operation.

A resistance body 61 is laid uniformly in the bottom of the groove in which fret 2 is embedded. The six conductors 59 constituting fret 2 pierce insulating material 60 so as to be electrically connected to resistance body 61.

On printed board 62 under resistance body 61 is formed a wiring pattern 63 which electrically contacts the overall surface of the lower side of resistance body 61.

Wiring pattern 63 is provided for each of frets 2 and electrically connected to a circuit to be described later which is installed in body 9 of FIGS. 1A and 1B.

Figure 29:
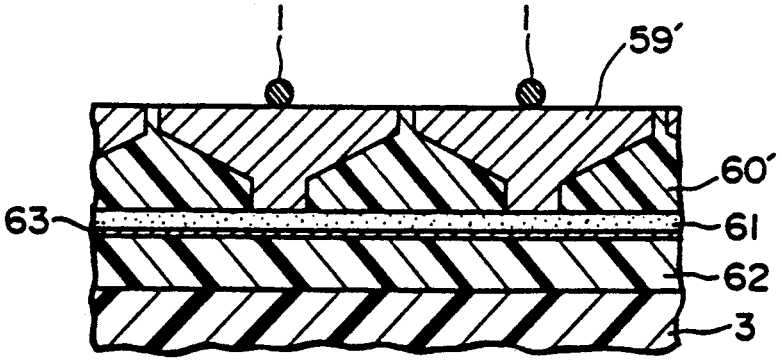
FIG. 29 is a diagram illustrating another structure of the frets in the twelfth embodiment.

Such a sectional form as shown in FIG. 29 may be used as an alternative to the sectional form of FIG. 28C. In this case, conductors 55' correspond to conductors 59, and insulating bodies 60' correspond to insulating bodies 60 of FIG. 28C.

Figure 30:
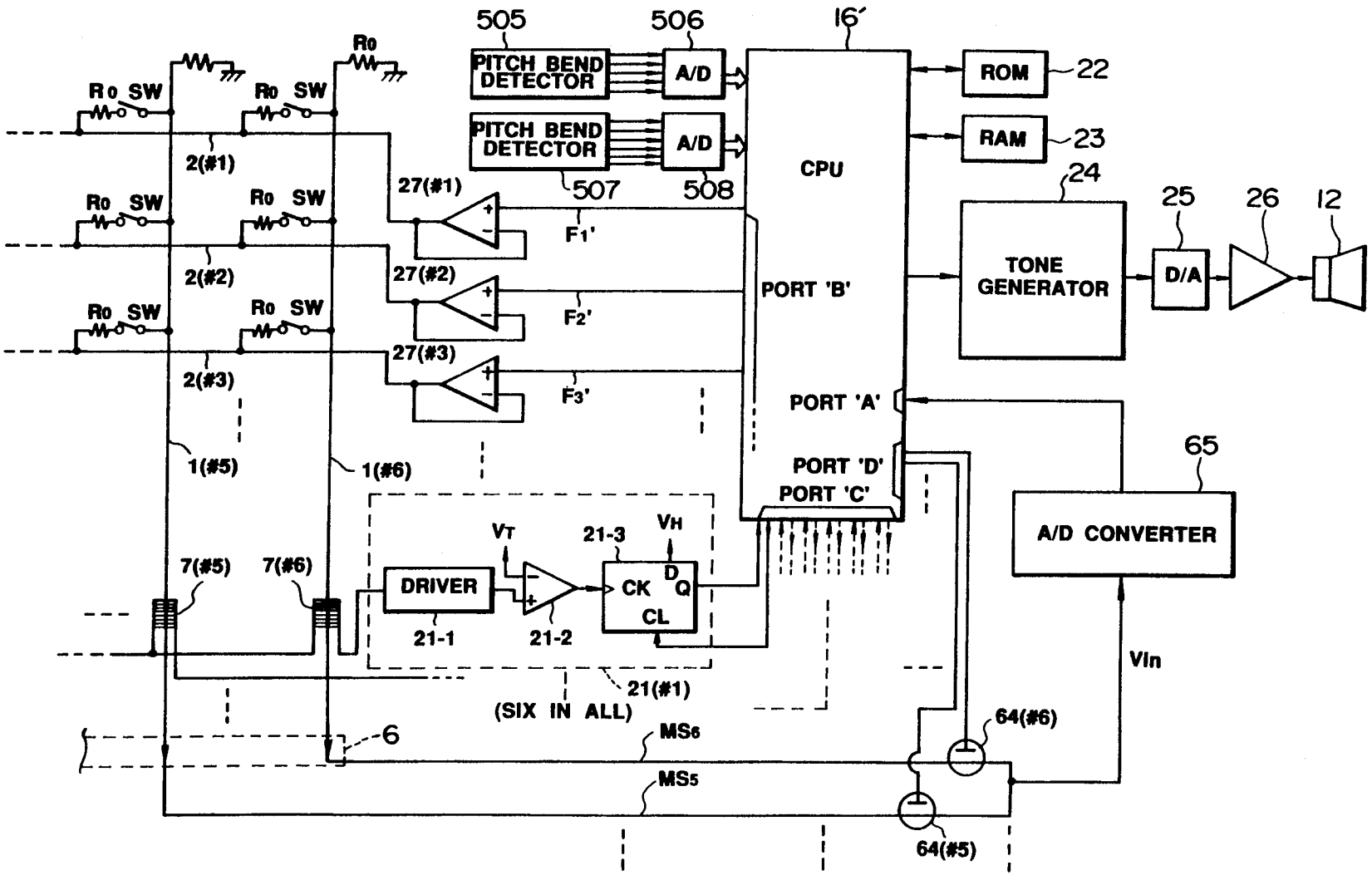
FIG. 30 is a block diagram illustrating the twelfth embodiment.

FIG. 30 is a block diagram of the twelfth embodiment based on the above fret configuration. In the present embodiment, as in the second embodiment shown in FIG. 11, the voltage pulses are applied to frets 2 and taken from strings 1.

Accordingly the arrangement and operation of CPU 16' for detecting the initiation of tone generation by means of pickups 7 (only #5 and #6 are shown) associated with strings 1 (#1-#6) through trigger detectors 21 are the same as those of the second embodiment of FIG. 11.

Furthermore, the arrangement and operation for detecting a pitch bend operation by means of pitch bend detectors 502 and 503 of FIGS. 1A, 1B and 1C through pitch bend detect circuits 505 and 507 and A/D converters 506 and 508 are the same as those of the second embodiment.

In other respects, for example, the relation of CPU 16' to tone generator 24, the present embodiment is the same as the second embodiment.

Voltage pulses F1', F2', F3', . . . output from port B of CPU 16' are applied to the noninverting input terminals of fret drivers 27 (#1, #2, #3, . . . ). Drivers 27 are the same as those of FIG. 11 in arrangement.

The outputs of fret drivers 27 are coupled to first fret 2 (#1), second fret 2 (#2), third fret 2 (#3), . . . via wiring patterns 63 (refer to FIG. 28C). Although actually frets 2 comprise the first fret (#1) through the twentieth fret (#20), only part thereof are shown in FIG. 30. As for strings 1 (#1-#6), only two strings (#5 and #6) are illustrated.

Each of strings 1 is pulled down to ground potential by a resistor of resistance Ro. As is the case with the first embodiment, this is to prevent input voltage Vin of A/D converter 65 from becoming indefinite when none of strings 1 contact any of frets 2. Because of the pull-down of each string to ground potential, input voltage Vin of A/D converter 65 is kept at ground potential in such a case, thus avoiding a malfunction.

String signals MS1 to MS6 (only MS5 and MS6 are shown in FIG. 30) taken from first to sixth strings (#1-#6; only #5 and #6 are shown) on bridge 6 (refer to FIG. 1A) are applied to A/D converter 65 as input voltage Vin via gates 64 (#1-#6; only #5 and #6 are shown). Each of gates 64 is switched by a corresponding control signal issued from port D of CPU 16'.

An output signal of A/D converter 65 is applied to port A of CPU 16'.

Operation of Twelfth Embodiment

The operation of the twelfth embodiment will now be described.

In FIG. 30, a portion of electrical contact between string 1 and fret 2 is equivalently shown by a switch element SW, and fret 2 has equivalently shown resistance Ro. Resistance Ro is formed of resistance body 61 between conductor 59 under corresponding string 1 and wiring pattern 63 on printed board 62 of FIGS. 28B and 28C.

Voltage pulses F1', F2', F3', . . . output from port B of CPU 16' of FIG. 30 sequentially go to high level potential VH representing logic 1 as shown in FIG. 12 in the second embodiment. Each of intervals in which the voltage pulses are raised to VH is divided into six subintervals so that gates 64 (#1-#6) may be sequentially turned on by corresponding control signals sequentially issued from port D of CPU 16' during the six subintervals (refer to P4 and P5 in FIG. 23). As a result, string signals MS1 to MS6 are applied from strings 1 to A/D converter 65 as its input voltage Vin.

When the first string (#1) and the second string (#2) are stopped as indicated at p and q in FIG. 31, the equivalent circuits of the FIG. 30 circuit in intervals in which voltage pulses Fn+2', Fn+1' or Fn' go to high level potential VH can be shown as in FIGS. 14A to 14C as is the case with the second embodiment.

CPU 16' of FIG. 30 sequentially selects string signals MS1 to MS6 of FIGS. 14A to 14C through gates 64 #1 to #6), causes A/D converter 65 to convert input voltage Vin to a digital value, and receives it from port A.

CPU 16' performs the same operations as in the flowchart of FIG. 24 in the ninth embodiment and can detect such a string-stopped state as shown in FIG. 31 correctly like the second embodiment.

There is a possibility that, when string 1 is subjected to a pitch bend operation, the string can go beyond slit 58 of FIGS. 28A and 28B to come into contact with conductor 59 corresponding to the adjacent string. As described in the first embodiment, however, no problem arises because the pitch bend operation is seldom performed simultaneously with a string stopping operation.

The twelfth embodiment of FIG. 30 has fret drivers 27 like the first to eighth embodiments. With the ninth embodiment of FIGS. 22A to 22C, on the other hand, the outputs of PORTs #1 to #3 drive switch portions 45 (#1 to #6) directly. This is because CPU 47 has enough fanout at each port in a case where the number of switches to be driven is small like the ninth embodiment. The ninth and twelfth embodiments perform substantially the same operation.

Other Embodiments

As described above, the twelfth embodiment shown in FIG. 12 uses a combination of gates 64 (#1-#6) and A/D converter 65 to detect string signals MS1 to MS6 like the ninth embodiment of FIG. 22A. Alternatively comparators 28 (#1 to #6) of FIG. 11 may be used instead. Or switching transistors may also be used as in the case of the tenth embodiment of FIG. 26.

In the twelfth embodiment, the fret configuration shown in FIG. 23 or 29 is used as fret 2 of FIGS. 1A and 1B. Like the second embodiment, the voltage pulses are applied to frets 2 and detected from strings 1 for detection of contact between fret 2 and string 1. Alternatively the system may be modified such that the voltage pulses are applied to strings 1 and detected from frets 2, like the first embodiment.

Furthermore, in the twelfth embodiment, as in the first and second embodiments, the pitch bend operation is detected through pitch bend detectors 502 and 503 of FIGS. 1A, 1B and 1C, pitch bend detect circuits 505 and 507 and A/D converters 506 and 508 of FIG. 30. Alternately, as in the third and fourth embodiments of FIG. 16 and 17, pickups 7 (#1-#6) may be arranged to detect vibrations of strings 1 directly and followed by pitch extracting analog section 35 and pitch extracting digital section 30. As a result, to an electronic stringed instrument of a type which extracts pitches from vibrations of strings to effect the control of production of tone signals, the fret detecting system based on the twelfth embodiment may be applied to speed up the initiation of tone generation. This will provide the same effect as the third and fourth embodiments.

In the first to eighth embodiments, on the other hand, voltage detection is performed by use of comparators. Alternatively, a combination of gates and an A/D converter may be used instead as in the case of the ninth or the twelfth embodiment. A digital value from the A/D converter will be decided by CPU using a program.

What is claimed is:

1. An operated switch detecting device including:

a plurality of row connection lines;

a plurality of column connection lines arranged to cross said row connection lines arranged to cross said row connection lines;

a plurality of manually operable switch elements (SW) provided at intersections of said row connection lines and said column connection lines;

resistance members respectively provided at said intersections of said row and column connection lines and each having a predetermined resistance value, a series circuit of a switch element and a resistance member being connected between corresponding row and column connection lines at said respective intersections;

voltage supply means for supplying voltage pulses to some of said row connection lines while keeping other row connection lines which are not supplied with voltage pulses at ground potential;

voltage detecting means for detecting values of voltage pulses supplied to said row connection lines by said voltage supply means from said column connection lines through said respective associated resistance members; and position detecting means for detecting a switch element being operated based on the values of the voltage pulses detected by said voltage detecting means.

2. An operated switch detecting device according to claim 1, wherein each of said resistance members is formed on at least one of said row connection line and said column connection line at an intersection thereof.

3. An operated switch detecting device according to claim 1, wherein each of said resistance members is formed integral with one of said row connection line and said column connection line at an intersection thereof.

4. An operated switch detecting device according to claim 1, wherein:

said row connection lines and said column connection lines are formed on a wiring board; and each of said manually operable switch elements is formed at a separate intersection of one of said row connection lines and one of said column connection lines on said wiring board.

5. An operated switch detecting device according to claim 1, wherein:

each of said manually operable switch elements has an elastic member which is subjected to elastic deformation when manually operated.

6. A position detecting device according to claim 1, wherein each of said row and column connection lines comprises a conductive line.

7. A position detecting device according to claim 1, wherein when a pulse detected by said position detecting means has a voltage value higher than a predetermined value, said position detecting means determines that a switch element at an intersection between a row connection line, to which a pulse is applied at the same timing as the detection, and a column connection line on which a pulse has been detected by said voltage detecting means, has been operated.

8. A position detecting device comprising:

a plurality of first conductive members disposed at predetermined intervals therebetween;

a plurality of second conductive members disposed over said first conductive members at predetermined intervals therebetween, said second conductive members being arranged to cross said first conductive members and adapted to be pressed to cause said first conductive members to contact a second conductive member when pressed;

resistance members respectively formed in parts of said first conductive members with which said second conductive members are brought into contact when pressed;

voltage supply means for supplying voltage pulses to some of said second conductive members while keeping other second conductive members which are not supplied with voltage pulses at ground potential;

voltage detecting means for detecting values of voltage pulses supplied to said second conductive members from said first conductive members through said respective associated resistance members; and position detecting means for detecting a position of intersections of first and second conductive members being pressed from among said plurality of first and second conductive members in accordance with values of voltage pulses detected by said voltage detecting means.

9. A position detecting device according to claim 8, wherein when a pulse detected by said position detecting means has a voltage value higher than a predetermined value, said position detecting means determines that an intersection between said second conductive member, to which a pulse is applied at the same timing as the detection, and said first conductive member on which a voltage pulse has been detected by said voltage detecting means, has been pressed.

10. An electronic musical instrument comprising:

a plurality of first conductive members disposed at predetermined intervals therebetween;

a plurality of second conductive members disposed over said first conductive members at predetermined intervals therebetween, said second conductive members being arranged to cross said first conductive members and adapted to be pressed to cause a first conductive members to contact a second conductive member when pressed;

resistance member respectively formed in parts of said first conductive members with which said second conductive members are brought into contact when pressed;

voltage supply means for supplying voltage pulses to some of said second conductive members while keeping other second conductive members which are not supplied with voltage pulses at ground potential;

voltage detecting means for detecting values of voltage pulses supplied to said second conductive members from said first conductive members through said respective associated resistance members;

position detecting means for detecting a position of an intersection of said first and second conductive members being pressed among said plurality of first and second conductive members subjected to pressing operation and a first conductive member from which in accordance with values of voltage pulses detected by said voltage detecting means; and pitch specifying means for specifying a pitch of a tone to be generated in accordance with the intersection position detected by said position detecting means.

11. An electronic musical instrument according to claim 10, further comprising tone generating means for generating a tone having the pitch specified by said pitch specifying means.

12. A position detecting device comprising:

a plurality of first conductive members disposed at predetermined intervals therebetween;

a plurality of second conductive members disposed over said first conductive members at predetermined intervals therebetween, said second conductive members being arranged to cross said first conductive members and adapted to be pressed to cause said first conductive members to contact a second conductive member when pressed;

resistance members respectively formed in parts of said first conductive members with which said second conductive members are brought into contact when pressed;

voltage supply means for supplying voltage pulses to some of said first conductive members while keeping other first conductive members which are not supplied with voltage pulses at ground potential;

voltage detecting means for detecting values of voltage pulses supplied to said first conductive members from said second conductive members through said respective associated resistance members; and position detecting means for detecting a position of an intersection of a resistance member and a second conductive members being pressed among said plurality of resistance members and second conductive members in accordance with values of voltage pulses detected by said voltage detecting means.

13. A position detecting device comprising:

a plurality of first conductive members disposed at predetermined intervals therebetween;

resistance members respectively formed on said first conductive members;

a plurality of second conductive members disposed on said resistance members and arranged to be electrically independent of one another;

a plurality of third conductive members disposed over said second conductive members and adapted to be brought into contact with said second conductive members;

voltage supply means for sequentially supplying voltage pulses to some of said third conductive members while keeping other third conductive members which are not supplied with voltage pulses at ground potential;

voltage detecting means for detecting values of voltage pulses supplied to said third conductive members from said first conductive members through said second conductive members and said respective associated resistance members; and position detecting means for detecting a position of an intersection of said third conductive members and said second conductive members being pressed in accordance with values of voltage pulses detected by said voltage detecting means.

14. A position detecting device comprising:

a plurality of first conductive members disposed at predetermined intervals therebetween;

resistance members respectively formed on said first conductive members;

a plurality of second conductive members disposed on said resistance members and arranged to be electrically independent of one another;

a plurality of third conductive members disposed over said second conductive members and adapted to be brought into contact with said second conductive members when depressed;

voltage supply means for supplying voltage pulses to some of said first conductive members while keeping other first conductive members which are not supplied with voltage pulses at ground potential;

voltage detecting means for detecting values of voltage pulses supplied to said first conductive members from said third conductive members through said second conductive members and said respective associated resistance members; and position detecting means for detecting a position of an intersection of said third conductive members and said second conductive members being pressed in accordance with values of voltage pulses detected by said voltage detecting means.

* * * * *